US009342002B2

(12) United States Patent
Morisawa et al.

(10) Patent No.: US 9,342,002 B2
(45) Date of Patent: May 17, 2016

(54) FIXING DEVICE AND IMAGE FORMING APPARATUS

(71) Applicants: Naoko Morisawa, Kanagawa (JP); Susumu Matsusaka, Kanagawa (JP); Motokazu Hasegawa, Kanagawa (JP); Yukari Isoe, Kanagawa (JP)

(72) Inventors: Naoko Morisawa, Kanagawa (JP); Susumu Matsusaka, Kanagawa (JP); Motokazu Hasegawa, Kanagawa (JP); Yukari Isoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/132,259

(22) Filed: Dec. 18, 2013

(65) Prior Publication Data

US 2014/0178088 A1 Jun. 26, 2014

(30) Foreign Application Priority Data

Dec. 25, 2012 (JP) ..... 2012-280527

(51) Int. Cl.
*G03G 15/20* (2006.01)
*G03G 15/00* (2006.01)

(52) U.S. Cl.
CPC ..... *G03G 15/2053* (2013.01); *G03G 15/2042* (2013.01); *G03G 15/80* (2013.01); *G03G 2215/0132* (2013.01)

(58) Field of Classification Search
CPC G03G 15/20; G03G 15/2042; G03G 15/2082
See application file for complete search history.

(56) References Cited

U.S. PATENT DOCUMENTS

| | | | | |
|---|---|---|---|---|
| 7,162,168 | B2 * | 1/2007 | Kunimori | 399/45 |
| 2009/0297197 | A1 | 12/2009 | Hase | |
| 2012/0045240 | A1 * | 2/2012 | Shimizu | 399/69 |
| 2012/0051775 | A1 * | 3/2012 | Miyata et al. | 399/69 |
| 2013/0142533 | A1 * | 6/2013 | Shimizu | 399/67 |

FOREIGN PATENT DOCUMENTS

| | | |
|---|---|---|
| JP | 2007-072022 | 3/2007 |
| JP | 2008-040176 | 2/2008 |
| JP | 2008-139475 | 6/2008 |
| JP | 2009-288725 | 12/2009 |
| JP | 2010-218952 | 9/2010 |
| JP | 2012-058655 | 3/2012 |
| JP | 2012-068676 | 4/2012 |
| JP | 2013-054396 | 3/2013 |

* cited by examiner

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A fixing device includes a rotary member comprising a heat generation layer; an excitation coil generating magnetic flux, disposed along an axial direction of the rotary member and opposite the rotary member, to heat by induction the heat generation layer; a first demagnetizing coil layered on the excitation coil and generating magnetic flux in a direction reverse to and cancel the magnetic flux that the excitation coil generates; a sheet size detector to obtain a size of a recording sheet on which an image is to be formed by passing through the rotary member; and a drive controller to control driving of the first demagnetizing coil. The drive controller drives the first demagnetizing coil after information including the sheet size information has been obtained.

12 Claims, 18 Drawing Sheets

FIXING DEVICE AND IMAGE FORMING APPARATUS

CROSS-REFERENCE TO RELATED APPLICATION

The present application claims priority pursuant to 35 U.S.C. §119 from Japanese patent application number 2012-280527 filed on Dec. 25, 2012, the entire disclosure of which is incorporated by reference herein.

BACKGROUND

1. Technical Field

The present invention relates to a fixing device and an image forming apparatus including the same.

2. Related Art

Conventionally, an image forming apparatus such as a copier, a printer, and the like, employs a fixing device employing electromagnetic induction, which is both fast and energy-efficient. Such a fixing device is comprised of a magnetic flux generator formed of an excitation coil and a center core, which generates a magnetic field, and a fixing roller, for example. An electromagnetic induction heat generation layer in the fixing roller is heated by the magnetic field thus generated. The fixing device described above can directly heat the heat generation layer, which has the advantage of allowing the thermal capacity of the fixing device to be made smaller than that of a halogen heater, for example, thereby providing high thermal efficiency and high-speed heating.

In fixing images on recording media of different widths, heat distribution varies laterally across the fixing member depending on the width of the recording media, resulting in an uneven temperature distribution across the fixing member. For example, when recording media with a small width are printed and fixed, because heat is absorbed from the fixing device by the recording media in the area through which the sheet passes (hereinafter also referred to as the sheet passing area), the temperature of that section of the fixing roller corresponding to the sheet passing area decreases compared to other areas. When particularly small-size recording media are continuously printed, heat absorption becomes acute.

As such, in a state in which the fixing temperature increases at lateral ends in an axial direction of the fixing member, when toner images on the recording media having a large width are fixed, hot offset occurs at a portion where the temperature has risen remarkably. Further, when the temperature at the axially lateral ends exceeds an upper temperature limit, the fixing member may be damaged due to the excessive heat.

It is possible to control the fixing temperature of an entire area in the axial direction based on the temperature at the axially lateral ends; however, because the heat in the sheet passing area is continuously absorbed from the fixing member, the necessary temperature for fixing cannot be maintained and the temperature decreases. As such, when toner images on the recording media are fixed in a state in which the fixing temperature decreases, cold offset occurs at a portion where the temperature has decreased.

There is an approach involving mounting a demagnetizing coil to form a magnetic field in a direction reverse to that of the excitation coil, on the excitation coil, so that the heating area of the fixing roller is adjusted by the demagnetizing effect of the demagnetizing coil.

JP-2008-139475-A discloses, as a first example, a fixing device employing electromagnetic induction in which, as illustrated in FIG. 16, an excitation coil 201 to form the magnetic field and a first demagnetizing coil 2100 and a second demagnetizing coil 2200 both to partially decrease the magnetic field overlap.

In addition, JP-2008-040176-A discloses, as a second example, a fixing device that includes an excitation coil to induction-heat a fixing roller; a demagnetizing coil to generate magnetic flux in a direction to erase a magnetic flux generated by the excitation coil, and a power supplying section to supply alternating current to the excitation coil and which is not connected to the demagnetizing coil electrically.

The fixing device in the first example is configured to switch ON and OFF each demagnetizing coil corresponding to the sheet size, so that different varieties of sheets can be handled. Accordingly, even though the small-sized sheets are continuously printed, an excessive rise of the temperature of the heat generator in the non-sheet passing area can be prevented. In addition, because the demagnetizing coils overlap, a seam between the demagnetizing areas is eliminated, thereby preventing an excessive temperature increase of the heat generator.

Further, the fixing device in the second example is configured such that the excitation coil and the demagnetizing coil are not connected electrically, thereby securely and effectively preventing an excessive temperature increase of the heat generator in the non-sheet passing area even though the small-sized sheets are continuously printed. The excitation coil can be disposed opposite the fixing roller via the demagnetizing coil, which is more effective in preventing temperature increase in the non-sheet passing area.

On the other hand, both of the above-described fixing devices include a demagnetizing coil that first detects the temperature increase in the non-sheet passing area at both lateral ends and operates responsive to the detection result. As a result, even though the printing condition of the first print is set for a small-size sheet, the entire fixing roller needs to be heated, resulting in heating areas not required for the first print.

Accordingly, although generally successful in preventing excessive temperature increase at both lateral ends of the heat generator, the above-described demagnetizing coils have non-optimal heating efficiency, so that a predetermined standby time is required until the fixing device becomes ready for fixing.

SUMMARY

The present invention provides a fixing device with improved heating performance so as to shorten the standby time before starting printing. The fixing device includes a rotary member comprising a heat generation layer; an excitation coil generating magnetic flux, disposed along an axial direction of the rotary member and opposite the rotary member, to heat by induction the heat generation layer; a first demagnetizing coil overlapping the excitation coil and generating magnetic flux in a direction reverse to and cancel the magnetic flux that the excitation coil generates; a sheet size detector to obtain a size of a recording sheet on which an image is to be formed by passing through the rotary member; and a drive controller to control driving of the first demagnetizing coil. Further, the drive controller drives the first demagnetizing coil after information including the sheet size information has been obtained.

These and other objects, features, and advantages of the present invention will become apparent upon consideration of the following description of the preferred embodiments of the present invention when taken in conjunction with the accompanying drawings.

DETAILED DESCRIPTION

Figure 1:
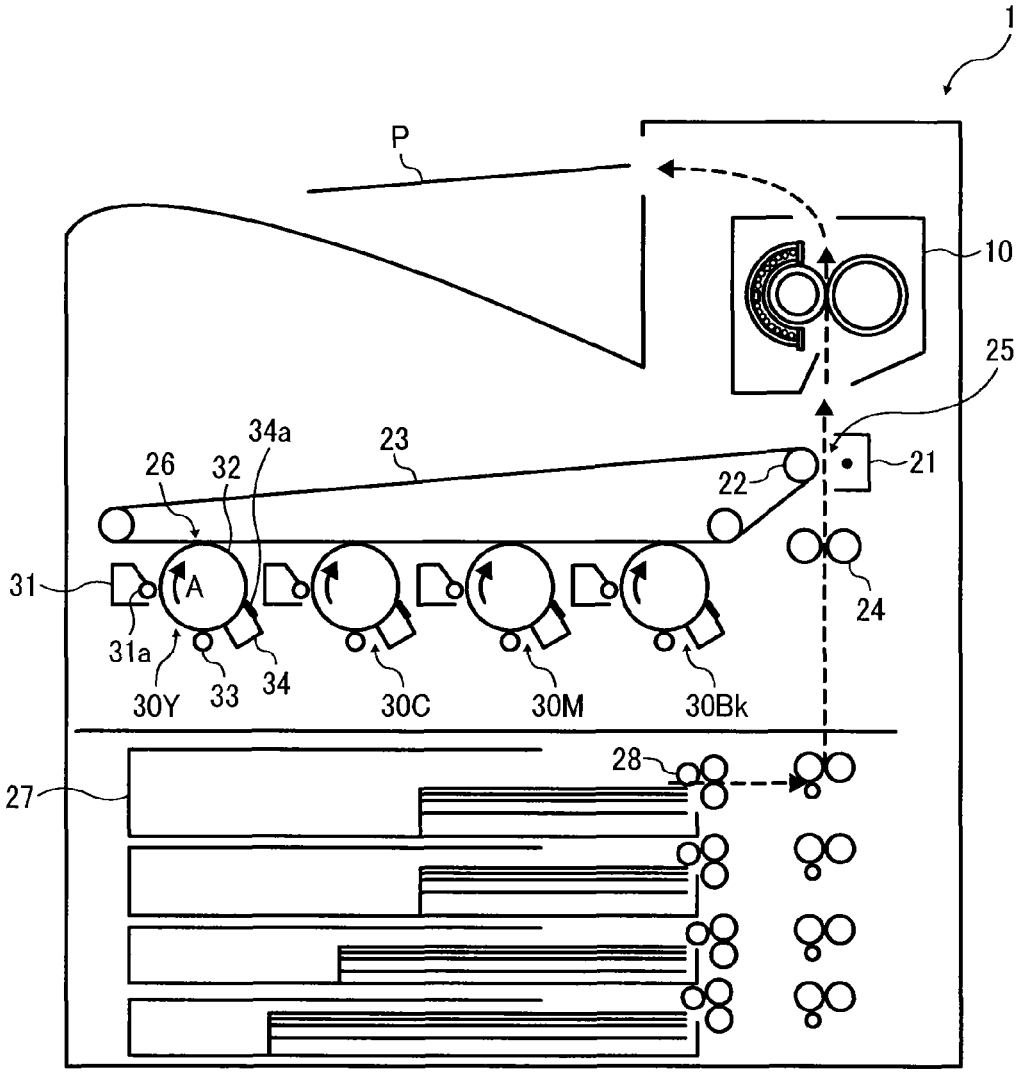
FIG. 1 is a schematic cross-sectional view illustrating an image forming apparatus according to one embodiment of the present invention.

Hereinafter, the present invention will be described referring to the accompanying drawings. In each figure, identical or corresponding parts are given the same reference numeral and a redundant explanation thereof is omitted or simplified as appropriate.

With reference to FIG. 1, a schematic configuration of an image forming apparatus according to an embodiment of the present invention will be described. FIG. 1 shows an image forming apparatus 1 as an example of a full-color printer employing the electrophotographic method of image formation. The image forming apparatus 1 is a printer in which a recording medium such as a sheet of paper is printed with a widthwise center thereof aligned to a longitudinal center of the printer, which is a so-called center-aligned printer.

The entire configuration of the image forming apparatus 1 will be described by dividing the image forming apparatus 1 into two parts—upper and bottom—for descriptive purposes. Although not illustrated herein, an automatic document feeder (ADF) and an optical unit including optical elements are disposed in an upper part of the image forming apparatus 1. In addition, an imaging unit is disposed below the optical unit.

In the bottom of the image forming apparatus 1, a sheet feed unit 27 including a plurality of paper trays is disposed. Sheets P of different sizes are stacked in each paper tray.

Next, image formation performed by the image forming apparatus 1 will now be described taking, as an example, one of multiple developers included in the imaging unit, that of developer 30Y for the color yellow. As illustrated in FIG. 1, a photoreceptor drum 32 formed of an electrophotographic-dedicated organic photoreceptor is rotated at a predetermined processing speed or a cyclic speed in The direction of Arrow A. The photoreceptor drum 32 is while rotating charged by a charging roller 33, to thus obtain a predetermined polarity and electric potential.

Next, laser beams L are output from a laser optical box as a laser scanner, not shown, onto the charged surface of the photoreceptor drum 32 via a mirror which reflects the laser beams L onto an exposure position of the photoreceptor drum 32. Thus, the photoreceptor drum 32 is scanned to expose the target image data.

The not-shown laser optical box outputs modulated laser beams L corresponding to time sequential electro-digital pixel signals of the given image data obtained from a computer, not shown, serving as an image data generating means, and scans and exposes the surface of the photoreceptor drum 32. Due to this exposure, a latent image corresponding to the target image data is formed on the surface of the photoreceptor drum 32.

In a case of the full-color image formation, a first color-decomposed component image, that is, a yellow component image is scanned and exposed and the latent image formation of yellow color is done. Then, the latent image is developed as a yellow toner image by operating the developer 30Y.

As illustrated in FIG. 1, the image forming apparatus 1 further includes an intermediate transfer belt 23. A primary transfer portion 26 is formed at a contact portion between the photoreceptor drum 32 and the intermediate transfer belt 23, or near the contact portion. The developed yellow toner image is transferred onto a surface of the intermediate transfer belt 23 at the primary transfer portion 26. A cleaner 34*a* is further included. A surface of the photoreceptor drum 32 after transferring the toner image onto the intermediate transfer belt 23 is cleaned by the cleaner 34*a*, that is, adhering residues such as residual toner remaining after the transfer is removed by the cleaner 34*a*.

A series of cyclic processes including charging, scanning and exposing, developing, primary transferring, and cleaning are sequentially performed, for example, in a magenta developer 30M to form a magenta-component image, a cyan developer 30C to form a cyan-component image, and a black developer 30Bk to form a black-component image. Specifically, a yellow toner image, a cyan toner image, a magenta toner image, and a black toner image are sequentially transferred in a superimposed manner onto a surface of the intermediate transfer belt 23 to create a target full-color toner image.

The intermediate transfer belt 23 rotates in contact with the photoreceptor drum 32 or in the vicinity of the photoreceptor drum 32 at a same cyclic speed with the photoreceptor drum 32 in Arrow-B direction in the figure. Then, the toner image on the photoreceptor drum 32 is transferred to the intermediate transfer belt 23 due to the difference in potential between the surface of the photoreceptor drum 32 and that of the intermediate transfer belt 23.

The image forming apparatus 1 further includes a transfer roller 22, and a secondary transfer portion 25 formed between the intermediate transfer belt 23 and the transfer roller 22. As described above, the color toner image synthesized on the intermediate transfer belt 23 is secondarily transferred onto the sheet P sent at a predetermined timing from the sheet feed unit 27, as follows. A registration roller pair 24 is disposed upstream of the secondary transfer portion 25 in the conveyance path of the sheet P. The sheet P stacked in each paper tray of the sheet feed unit 27 is sent via a sheet feed roller 28 toward the registration roller pair 24. The sheet P fed out from the paper tray by the sheet feed roller 28 passes through the conveyance path as shown by a broken line, and stops at a position of the registration roller pair 24. Then, feeding of the sheet P is controlled such that the toner image on the intermediate transfer belt 23 can be transferred onto the sheet P at the secondary transfer portion 25. The sheet P suspended by the registration roller pair 24 is sent from the registration roller pair 24 toward the secondary transfer portion 25 timed to coincide with the arrival of the toner image on the intermediate transfer belt 23.

The transfer roller 22 is supplied with electrical potential with a polarity opposite that of the toner from a back of the sheet P, so that a synthesized color toner image is sequentially transferred en bloc from an outer surface of the intermediate transfer belt 23 to the sheet P. The sheet P, which has passed through the secondary transfer portion 25 is separated from the surface of the intermediate transfer belt 23 and is introduced into a fixing device 10. The unfixed toner image on the sheet P is heated and fused by the fixing device 10, and thereafter, the sheet P is discharged as a color-image formed material onto a discharge tray outside the image forming apparatus.

The image forming apparatus 1 forms an image on both sides of the sheet P. For example, the sheet P discharged to an automatic duplex unit, not shown, by a branching claw, not shown, is switched back by the automatic duplex unit and is conveyed to a conveyance path before the registration roller pair 24.

Next, with reference to FIGS. 2 to 4, a schematic configuration of the fixing device 10, which according to the present embodiment employs electromagnetic induction heating, will be described.

Figure 2:
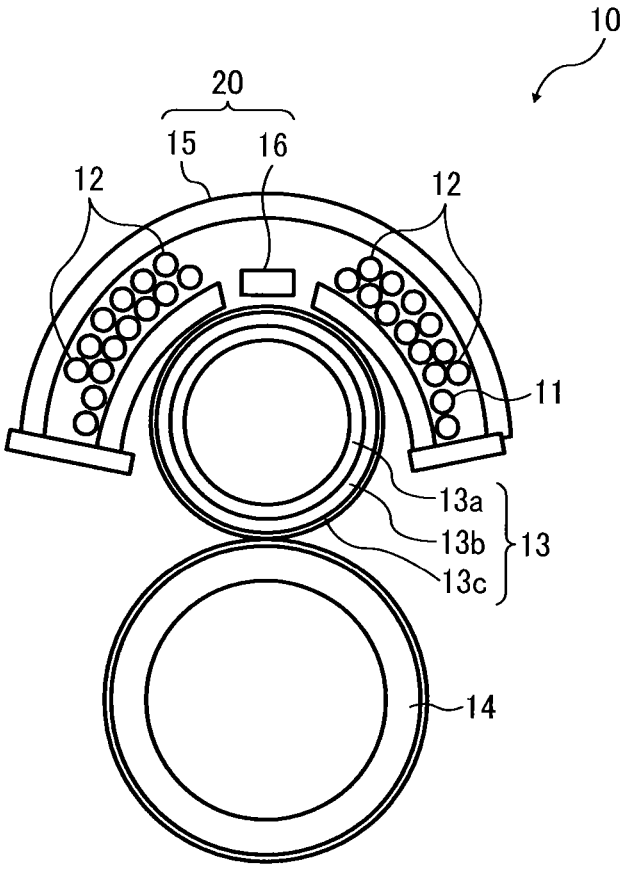
FIG. 2 is a cross-sectional view of a fixing device disposed in the image forming apparatus according to a first embodiment of the present invention.

As illustrated in FIG. 2, the fixing device 10 includes an excitation coil 11 as a magnetic flux generating means, a fixing roller 13 as a rotary member including a heat generating member, a pressure roller 14, a temperature sensor, not shown, and the like.

The fixing roller 13 has a multi-layer structure including a hollow metal core or a core metal layer 13*a* formed of a non-magnetic material, an elastic layer 13*b* form on the metal core 13*a*, and a heat generation layer 13*c* formed on the elastic layer 13*b*. Specifically, the fixing roller 13 has an outside diameter of 40 mm and includes the elastic layer 13*b*, the heat generation layer 13*c*, an oxidation preventive layer and a releasing layer, both not shown, are laminated on the metal core 13*a*.

The core metal layer 13*a* has enough strength to bear a load on the fixing roller 13 for forming a nip area. Thus, a metal such as iron is used for the metal core 13*a*. The metal core 13*a* also employs non-magnetic, insulating materials such as ceramics so as not to affect the induction heating.

In the present embodiment, SUS304, non-magnetic stainless steel, is used for the core metal layer 13*a*. Then, the thickness of the core metal layer 13*a* is thinned to be as much as 0.4 mm so that a thermal capacity is small and the energy of induction heating is focused on the heat generation layer 13*c*.

Elastic members such as fluororubber, silicon rubber, and fluorosilicon rubber can be employed for the elastic layer 13*b*. Because the elastic layer 13*b* is employed in the fixing roller 13, bending of the fixing roller 13 is allowed and a width of the nip area can be increased. In addition, the roller of the elastic layer 13*b* is softer than the pressure roller 14, thereby improving discharging and releasing abilities of the recording medium such as a sheet of paper.

In addition, if the elastic layer 13*b* is formed of sponge rubber, heat from the heat generation layer 13*c* can be retained. As a result, the elastic layer 13*b* or the release layer disposed on an outer surface of the fixing roller 13 can be swiftly heated. As a result, a surface of the fixing roller 13 reaches a predetermined temperature necessary for fixing, and even though heat is absorbed by the sheet P, heat supply can catch up to and compensate for the absorbed heat that is lost.

With such a configuration, an optimal nip area can be formed and heat generation in the heat generation layer 13*c* can be retained, so that heat is prevented from being transmitted to an interior of the fixing roller 13.

In the fixing device 10 according to the present embodiment, the elastic layer 13*b* employs foamed silicon rubber having an approximate thickness of 9 mm. As a result, heat of the heat generation layer 13*c* disposed on the surface layer of the fixing roller 13 does not migrate into the interior of the fixing roller 13 easily, and thus effective heating can be achieved.

The heat generation layer 13*c* is formed of highly conductive metal materials. As metal materials suitable for the induction heating, ones with high resistance are known in general; however, thin-layered, highly conductive metal materials are preferred because substantial resistance of the heat generation layer 13*c* can be set at will and heat generation performance can be improved.

In the fixing device 10 according to the present embodiment, a copper layer with a thickness of 10 μm is used for the heat generation layer 13*c*. Alternatively, for the heat generation layer 13*c*, other highly conductive metal materials such as argent, aluminum, magnesium, or magnetic nickel may be used.

A release layer, not shown, is formed as the topmost layer of the fixing roller 13. The release layer may be formed of fluorine resins such as: polytetrafluoroethylene (PTFE); tetrafluoroethylene-perfluoroalkyl vinylether copolymer (PFA); and tetrafluoroethylene-hexafluoropropylene copolymer (FEP), or mixture of these resins, or heat resistant resins dispersed with above resins.

The thickness of the release layer ranges from 5 to 50 μm. With such a range, the toner releasability from the fixing roller 13 and the flexibility of the fixing roller 13 as well can be secured. More preferably, for improving the toner releaseability and the flexibility of the fixing roller 13, the thickness of the release layer preferably ranges from 10 to 30 μm.

An excitation coil 11 is positioned opposite the heat generation layer 13*c*. As shown in FIG. 2, in order from outside inward to the center of the roller, there are included the excitation coil 11, a demagnetizing coil 12, the excitation coil 11, and the heat generation layer 13*c*. The excitation coil 11 and the demagnetizing coil 12 form a layered structure.

A magnetic field generated by the excitation coil 11 heats by induction the heat generation layer 13*c*, which heats the fixing roller 13. When the sheet P passes between the fixing roller 13 and the pressure roller 14, because the sheet P is heated by the fixing roller 13, fused toner is soaked into the sheet P, and thus, the image is fixed onto the sheet P.

The excitation coil 11 is formed such that 92 copper wires each having insulated surfaces with an outer diameter of approximately 0.15 mm each are bound together, and the thus-formed wire bundle extends in the rotary axis direction of the fixing roller 13 and winds in the circumferential direction of the fixing roller 13.

A ferrite core includes a first core 15 and a second core 16. The first core 15 is positioned opposed to the circumferential surface of the fixing roller 13 and in the back of the excitation coil 11. The second core 16 is positioned opposed to the circumferential surface of the fixing roller 13 without the excitation coil 11 in between and is disposed at a position nearer to the fixing roller 13 than the first core 15 is. Because the ferrite core is configured as above, the magnetic flux generated by the excitation coil 11 can be centralized in the heat generation layer 13*c*.

Preferred materials for the first and second cores 15 and 16 are ferromagnetic materials and ones with high electrical resistivity. Other than the ferrite core, preferably permalloys may be used.

The length of the fixing roller 13 in the rotary axis direction is approximately 310 mm in the present embodiment. This is because a maximum length of the recording medium handled by the fixing device 10 is set to 297 mm, which is the width of an A3-size sheet. As a result, the length of the fixing roller 13 in the rotary axis direction is greater than that of the A3-size sheet.

Next, referring to FIG. 3, structures of the excitation coil 11 and the demagnetizing coil 12 as a first demagnetizing coil related to the fixing device 10 according to the present embodiment will be described.

As described above, the excitation coil 11 is formed such that 92 copper wires each having insulated surfaces with an outer diameter of approximately 0.15 mm each are bound together, and the wire bundle thus formed is wound around the fixing roller 13 so as to spirally cover the fixing roller 13.

In addition, the shape of the excitation coil 11 is pressed and extends in the rotary axis direction of the fixing roller 13 with the second core 16 set as a shaft and cyclically winds around the fixing roller 13 in the circumferential direction. The excitation coil 11 includes a straight portion 11*a* in which the wire bundle is straight and parallel to the rotary axis direction of the fixing roller 13 and a curved portion 11*b* at its end.

Because the strength of the magnetic field generated is different between the straight portion 11*a* and the curved portion 11*b*, the length of the excitation coil 11 in the rotary axis direction is set to the length in which the straight portion 11*a* corresponds to the fixing roller 13, to make the amount of heat generated uniform in the rotary axis direction of the fixing roller 13.

On the other hand, the demagnetizing coil 12 is preferably formed to have a heat generation inhibition ratio suitable for the fixing device 10. Specifically, the heat generation inhibition ratio is dependent on the shape of the demagnetizing coil 12. The shape of the demagnetizing coil 12 in particular relates to a shape of a cross-sectional area of the coil conductive wire in the surface perpendicular to the rotary axis of the fixing roller 13.

Similarly to the excitation coil 11, the demagnetizing coil 12 extends in the rotary axis direction of the fixing roller 13 with the second core 16 set as an axis and winds around the fixing roller 13 in the circumferential direction of the fixing roller 13. In the present embodiment, the demagnetizing coil 12 overlaps or is piled on the excitation coil 11; however, the demagnetizing coil 12 may be sandwiched between the excitation coil 11 and the fixing roller 13, that is, more correctly, the heat generation layer 13*c*. The demagnetizing coil 12 is formed such that 12 copper wires each having insulated surfaces with an outer diameter of approximately 0.15 mm each are bound together.

In the present embodiment, when the relay circuit is open, the demagnetizing coil 12 does not affect greatly on the magnetic flux of the excitation coil 11; however, the demagnetizing coil 12 consumes a small amount of electricity of the magnetic flux of the excitation coil 11. Accordingly, depending on the conditions of thin wires constituting the demagnetizing coil 12, performance of heating the heat generation layer is degraded. Accordingly, the conditions of the thin wires constituting the demagnetizing coil 12 need to be considered. Specifically, the outer diameter of the thin wire is preferred to be 0.44 mm or less.

The thin wire constituting the demagnetizing coil 12 is preferably formed of thin wires having a cross-sectional area equal to or less than that of the thin wires constituting the excitation coil 11. In addition, the number of thin wires is preferably greater. The excitation coil 11 and the demagnetizing coil 12 are preferably disposed adjacent to each other. However, if the excitation coil 11 and the demagnetizing coil 12 are too close together, heating efficiency of the excitation coil 11 is prevented due to the heat generation of the demagnetizing coil 12. Accordingly, preferably the excitation coil 11 and the demagnetizing coil 12 are separated by a distance of 0.1 mm or more.

Figure 3:
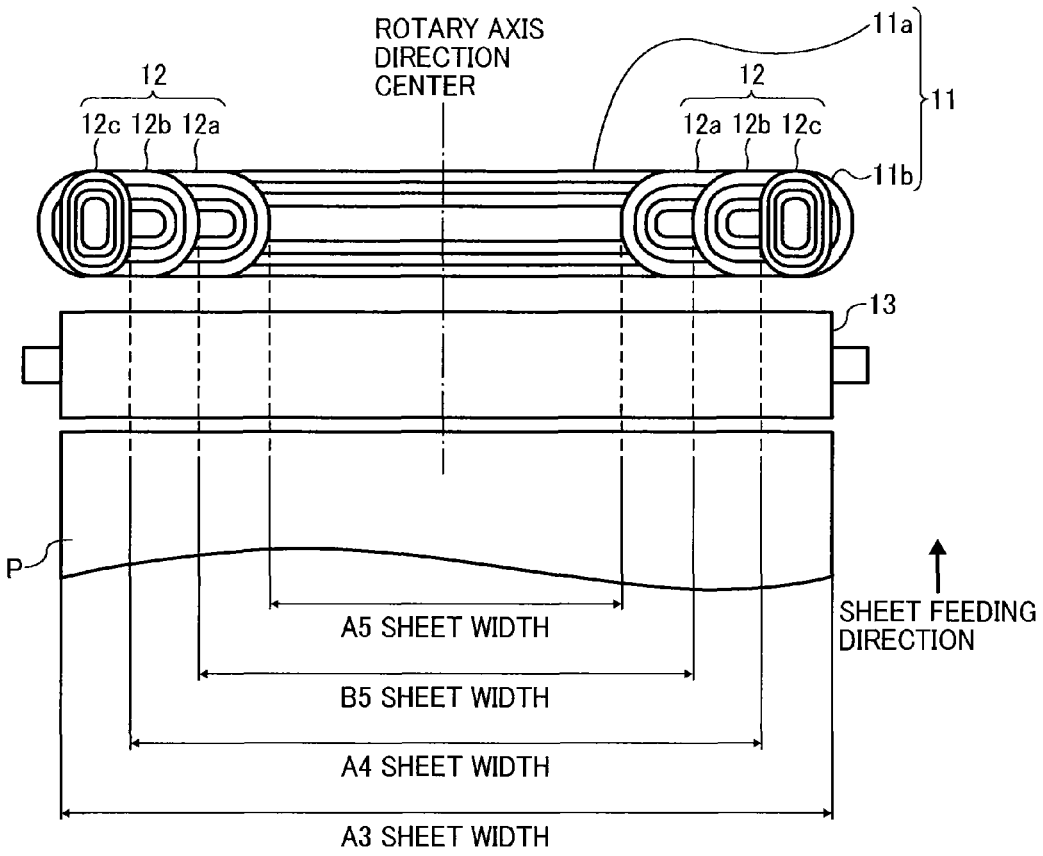
FIG. 3 is a schematic view of the fixing device seen in the width direction according to the first embodiment of the present invention.
Figure 4:
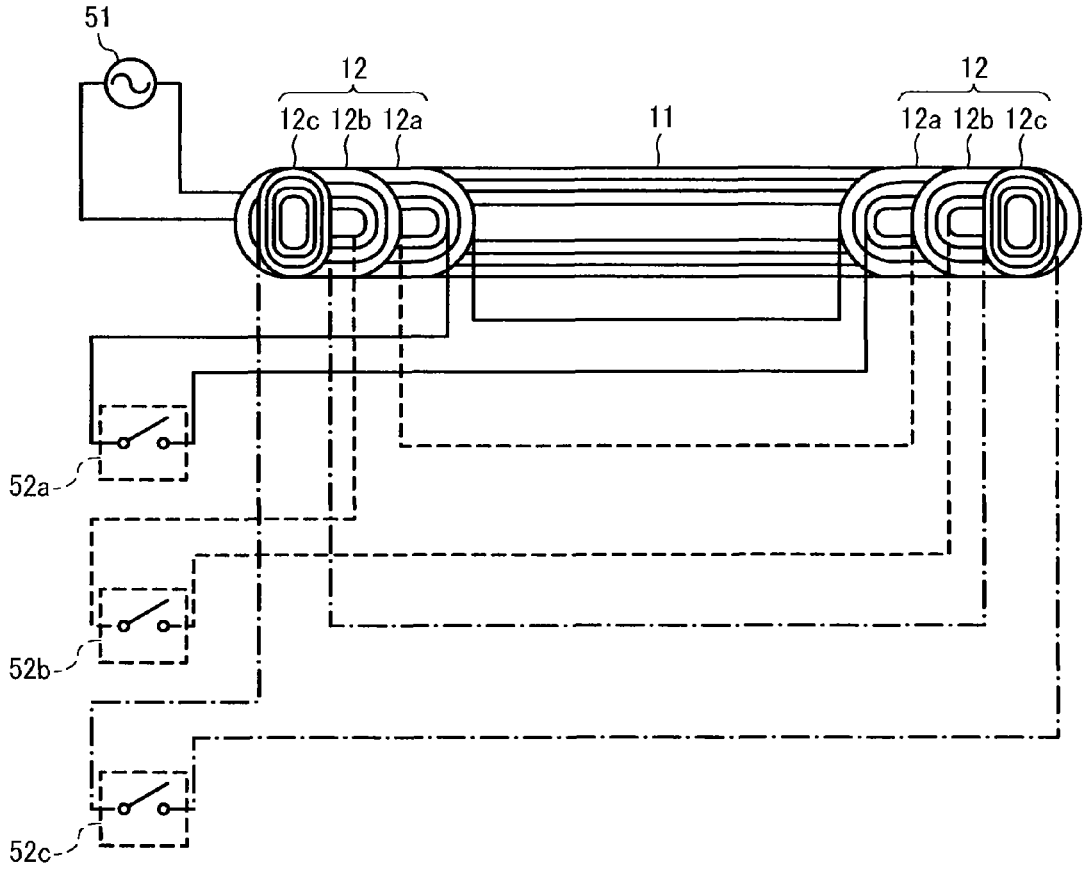
FIG. 4 is a schematic view of demagnetizing coils with selector switches included in the fixing device according to the first embodiment of the present invention.

As illustrated in FIG. 3, a plurality of demagnetizing coils 12 is disposed symmetrically with the center of the rotary axial direction of the fixing roller 13 as an axis. In the present embodiment, a pair of symmetrically disposed demagnetizing coils 12 overlaps the excitation coils 11 on both lateral ends of the to-be-fed sheet P. For example, in the present embodiment, the fixing roller 13 can perform fixation of images on sheets of different sizes, such as A3, A4, B5, and A5.

Specifically, a pair of demagnetizing coils 12*a* is disposed at opposite positions outside both lateral ends of the A5-size sheet, a pair of demagnetizing coil 12*b* at opposite positions outside both lateral ends of the B5-size sheet, and a pair of demagnetizing coil 12*c* at opposite positions outside both lateral ends of the A4-size sheet. Each pair of demagnetizing coils 12 is disposed at positions corresponding to a non-sheet-passing area when the A5-, B5-, or A4-size sheet passes the fixing roller 13. Specifically, the external dimensions of the demagnetizing coils 12*a*, 12*b*, and 12*c* are each different from the others in the axial direction of the fixing roller 13. In addition, the excitation coil 11 and the demagnetizing coil 12 are not connected to each other electrically. As a result, even though each winding direction of the wire flux of the excitation coil 11 and the demagnetizing coil 12 is the either same or reversed, the magnetic flux generated from the excitation coil 11 induces a back electromotive force.

Next, a switching circuit to activate the demagnetizing coil 12 in the fixing device 10 according to the present embodiment will be described referring to FIG. 4.

The switching circuit is implemented as a selector switch 52 connected to both ends of demagnetizing coils 12*a*-12*c* (referred to collectively as demagnetizing coil 12). In addition, the excitation coil 11 is connected to a power supply 51 that activates the excitation coil 11.

Figure 5:
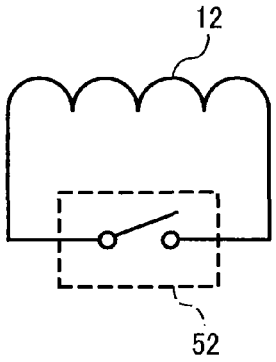
FIG. 5 is a circuit diagram of a switching circuit formed of each demagnetizing coil and a selector switch in the fixing device according to the first embodiment of the present invention.

In the present embodiment, a selector switch 52*a* to activate the demagnetizing coil 12*a*, a selector switch 52*b* to activate the demagnetizing coil 12*b*, and a selector switch 52*c* to activate the demagnetizing coil 12*c* are provided. For example, when the selector switch 52*a* is closed so that the closed circuit with the demagnetizing coil 12*a* is formed, the demagnetizing coil 12*a* can be activated. Schematically, as illustrated in FIG. 5, when the selector switch 52 is closed, the demagnetizing coil 12 is activated.

Next, functional blocks of the fixing device 10 included in the image forming apparatus 1 according to the present embodiment will be described with reference to FIG. 6.

The image forming apparatus 1 includes a control panel 100 for a user to input instructions to the image forming apparatus 1 to perform various operations, a controller 200 as a control means to control all operations performed by the image forming apparatus 1, and a fixing controller 300 as a fixing control means specifically to operate the fixing device 10. The fixing device 10 may be configured to include the fixing controller.

In addition, the image forming apparatus 1 of the present embodiment includes a fixing temperature detector 400 to detect a temperature of the fixing roller 13 and a sheet size detector 500 such as a sensor to detect a sheet size. The fixing temperature detector 400 may employ a temperature sensor such as a thermistor as described above. Information on the temperature of the fixing roller 13 detected by the fixing temperature detector 400 is sent to the controller 200.

In addition, the sheet size detector 500 is disposed at a predetermined position on the paper tray and detects a size of the fed sheet. The sheet size information detected by the sheet size detector 500 is sent to the controller 200. Further, the sheet size information can be obtained from the image data read by a scanner, not shown, included in the image forming apparatus 1. In addition, the image forming apparatus 1 according to the present embodiment receives image data or a request to print information from a computer 600 connected via a network 700.

The controller 200 includes a CPU 210, a ROM 220 storing programs for the image forming apparatus 1 to run and various data necessary for operating the programs, and a RAM 230 to store the necessary data for operating the image forming apparatus 1. A sheet size of the sheet P detected by the size detector 500 of each paper tray is input to the controller 200, which inputs the data into the fixing controller 300. The data recognized by the fixing controller 300 is used for a control process to be described below.

The fixing controller 300 includes a drive controller 310 and a driver section 320 to drive the excitation coil 11 and the demagnetizing coil 12. Then, the drive controller 310 includes a demagnetizing coil selector 311, an excitation drive controller 312, and a demagnetizing drive controller 313. The demagnetizing coil selector 311 selects a desired demagnetizing coil 12 based on the sheet size data, and the like, obtained from the controller 200.

In addition, the excitation drive controller 312 sends an excitation drive control signal to the driver section 320 to drive the excitation coil 11. The excitation drive controller 312 receives, for example, a print signal from the controller 200 and the driver section 320 sends an excitation drive signal. The excitation drive controller 312 receives, for example, information on the detected temperature of the fixing roller 13 from the fixing roller 13 and sends a signal to continue or stop excitation driving by the driver section 320.

In addition, the demagnetizing drive controller 313 sends a demagnetizing drive control signal to the driver section 320 to drive the demagnetizing coil 12. The excitation drive controller 313 receives, for example, a print signal, image size information, or sheet size information from the controller 200 and sends an excitation drive signal to be exerted by the driver section 320. The demagnetizing drive controller 313 receives, for example, information on the detected temperature of the fixing roller 13 from the controller 200 and sends a signal to start, continue, or stop demagnetizing driving by the driver section 320.

Figure 16:
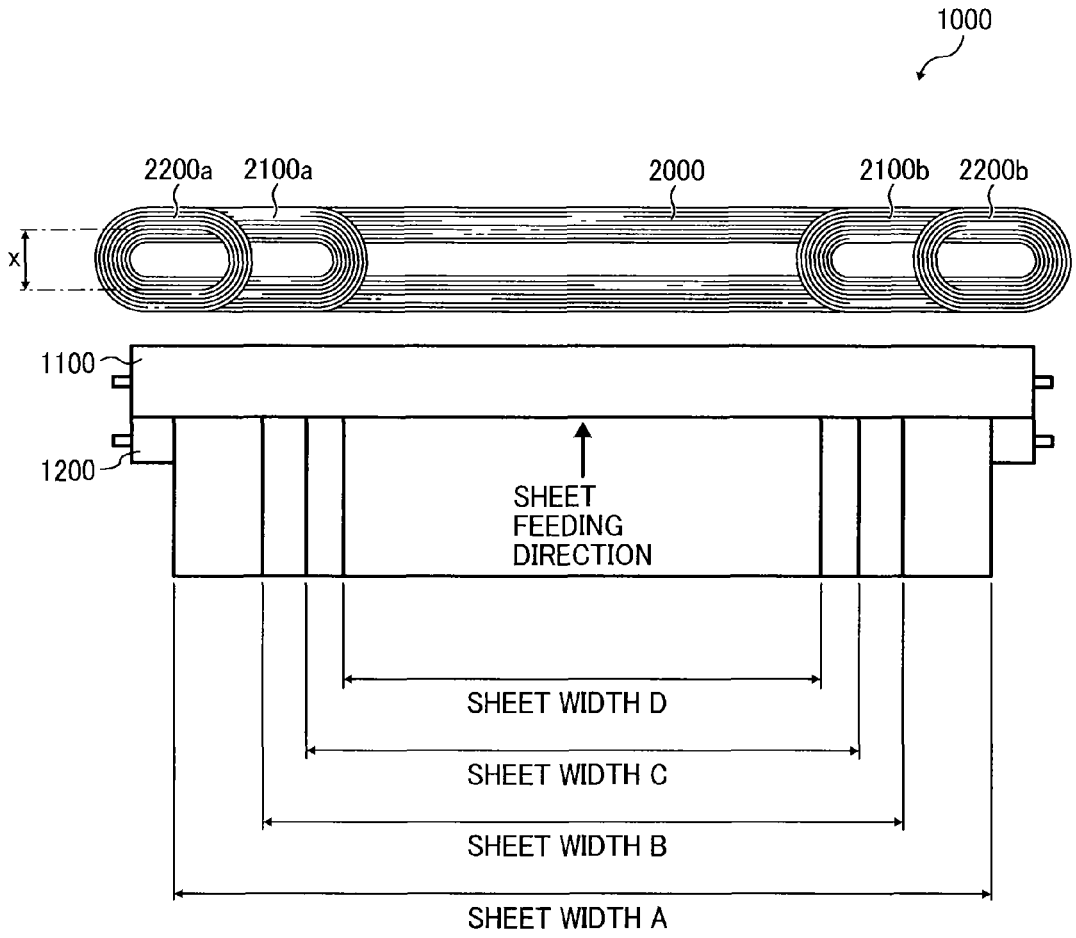
FIG. 16 BACKGROUND ART
FIG. 16 is a schematic view of a background-art fixing device.
Figure 17A:
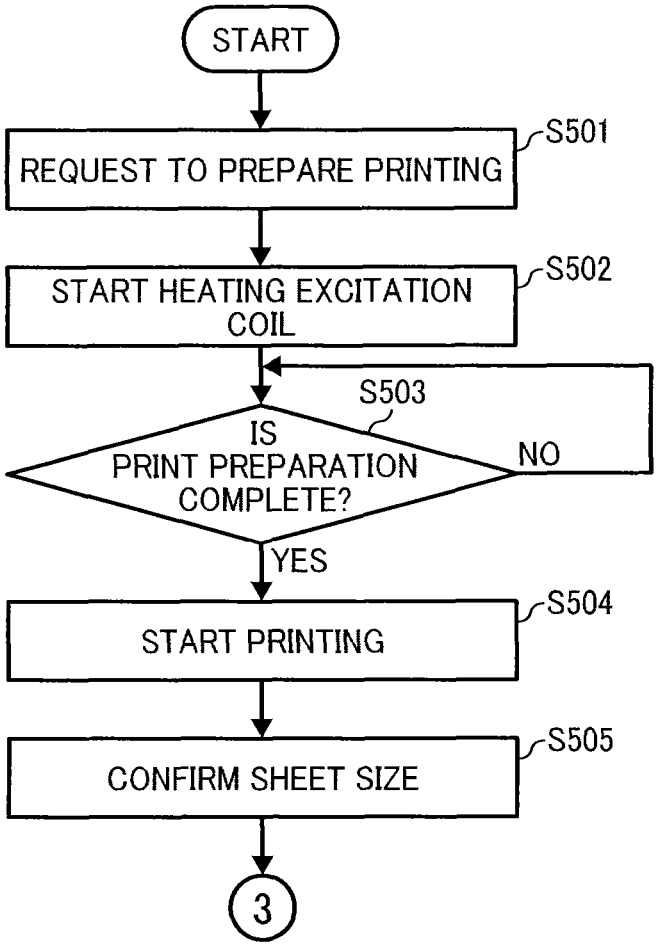
FIG. 17A BACKGROUND ART
FIGS. 17A and 17B are control flow charts of the demagnetizing coil included in the background-art fixing device shown in FIG. 16.
Figure 17B:
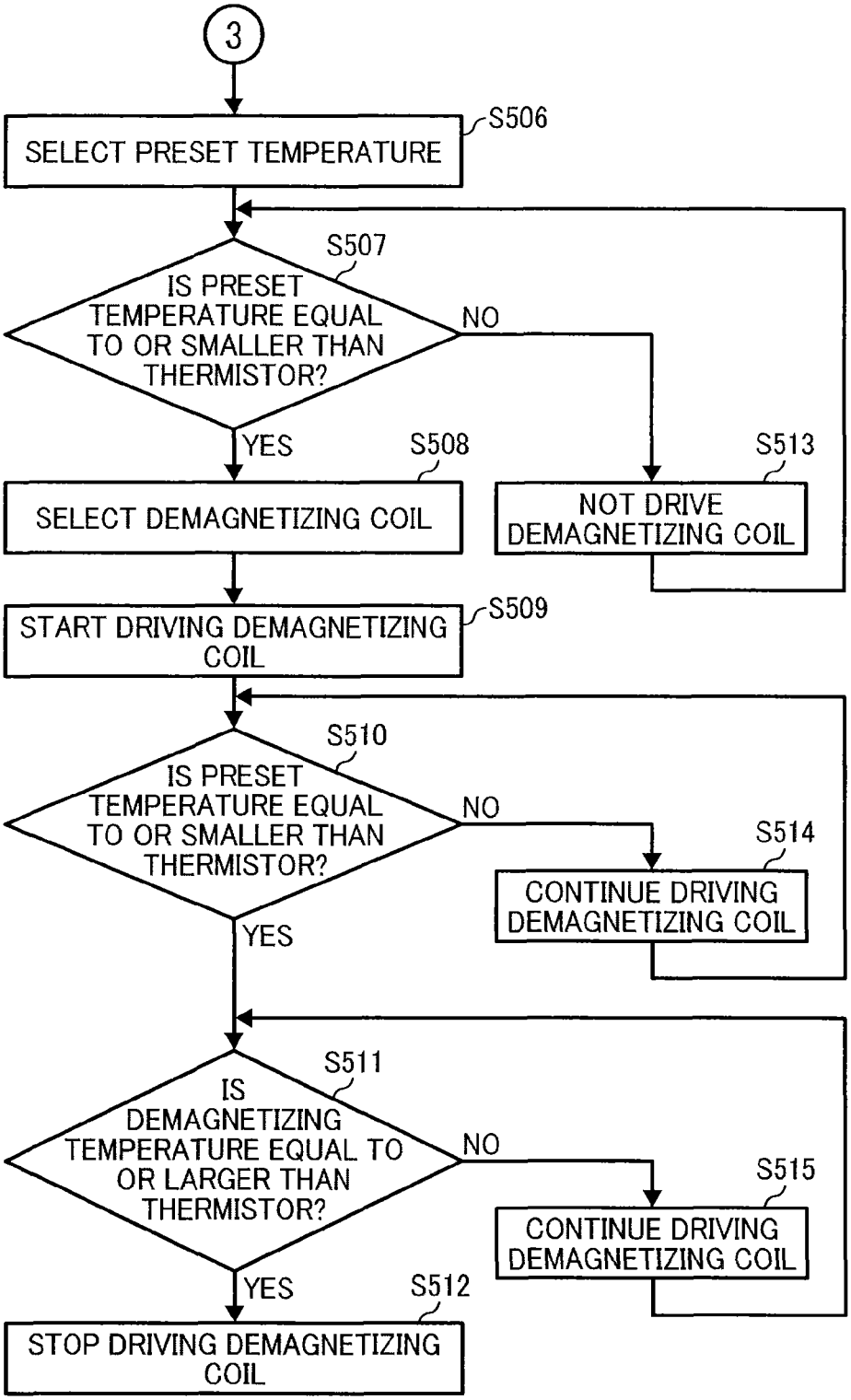
FIG. 17B BACKGROUND ART

To facilitate an understanding of the present invention, control processing by a conventional fixing device 1000 will be described referring to FIGS. 16 to 17B. First, the image forming apparatus receives a request-to-prepare-printing signal from a computer, not shown, and starts to prepare printing (Step S501). Then, heating a fixing roller 1100 is started (Step S502). Specifically, because a high-frequency alternating current is supplied to an excitation coil 2000, magnetic fluxes are formed in the excitation coil 2000 so as to be alternately switched in a reciprocal direction. Thus, when the alternate magnetic field is formed, an eddy current is generated in the fixing roller 1100 and joule heat is generated, and thus the fixing roller 1100 is induction-heated.

Upon completion of heating the fixing roller 1100 and print preparation (Yes in Step S503), the image forming apparatus starts printing (Step S504). The image forming apparatus continues to heat the excitation coil 2000 if the preparation for printing is not completed (No in Step S503).

The image forming apparatus verifies sheet information after starting printing (Step S505). The sheet information is obtained from image data that the image forming apparatus has received, which includes information related to size, thickness, and type of the sheet, such as a special sheet. Then, the image forming apparatus selects a suitable sheet P in the sheet feeder based on the sheet information and feeds a sheet. In addition, the image forming apparatus stores the sheet information in a memory device installed in the apparatus and uses the stored information as a control parameter for the fixing device.

Further, a heat generation layer as a part of the surface layer of the fixing roller 1100 generates heat, and the heat is retained by an elastic layer, and thus, the temperature of the surface layer increases and heat rise property is improved. Heat rise property indicates a temperature rise time to reach a temperature necessary for the fixing roller 1100 to fix enough the toner. As the rise time is shorter, the image forming apparatus is regarded optimal for the user.

When the temperature of the fixing roller 1100 attains a predetermined temperature, the image forming apparatus is print-enabled. The toner image on the sheet P conveyed is heated and fused by the heat from the fixing roller 1100.

The fixing device 1000 includes temperature detectors, not shown, disposed at positions corresponding to lateral ends of the sheet passing areas of respective sheets A5, B5, A4, and A3. Based on the temperatures detected by the temperature detectors, power input to the demagnetizing coils 2100 and 2200 and the excitation coil 2000 is controlled. The temperature detector may employ a thermistor; however, other types of temperature sensors may be used. The temperature detector can be disposed either contacted to the fixing roller 1100 or non-contacted thereto.

The image forming apparatus selects a preset temperature for fixing (Step S506). The image forming apparatus, upon start of continuous printing, controls the temperature of the sheet passing area to be kept at 170 degrees C., a preset temperature for fixing. The sheet P contacts the fixing roller 1100 at the sheet passing area. However, the temperature of the lateral ends of the fixing roller continues to increase because the heat in the non-sheet passing area is not absorbed. The temperature at the lateral ends of the fixing roller 1100 is controlled to be kept constant.

When the temperature of the lateral ends of the fixing roller detected by the thermistor exceeds a preset temperature (Yes in Step S507), the image forming apparatus selects any one of the demagnetizing coils 2100 and 2200 depending on the sheet size and drives the selected demagnetizing coil (Step S508). More specifically, upon the temperature at the lateral ends of the fixing roller 1100 reaching 180 degrees C., which is higher than the preset temperature by 10 degrees, the image forming apparatus operates any one of demagnetizing coils and restricts heat generation at the lateral ends. Which demagnetizing coil should be operated is determined based on the information stored in the memory device in the apparatus. On the other hand, the image forming apparatus does not operate the demagnetizing coil (Step S513) when the detected temperature is below the temperature preset for the fixing (No in Step S507).

Successively, the image forming apparatus detects the temperature of the fixing roller via the thermistor, and, when the detected temperature at the lateral ends of the fixing roller 1100 falls below the temperature preset for the fixing due to driving of the demagnetizing coil (Yes in Step S510), the image forming apparatus determines whether the detected temperature corresponds to the temperature to stop the demagnetizing coil (Step S511). When it is detected that the detected temperature falls below the temperature, at which the demagnetizing coil should be stopped (Yes in Step S511), the image forming apparatus stops driving the demagnetizing coil (Step S512).

On the other hand, when the detected temperature at the lateral ends of the fixing roller 1100 still exceeds the preset temperature for the fixing (No in Step S510) even though the demagnetizing coil is driven in Step S510, the image forming apparatus continues to drive the demagnetizing coil (Step S514). In addition, when the detected temperature at the lateral ends of the fixing roller 1100 exceeds the temperature at which the demagnetizing coil should be stopped (No in Step S511), the image forming apparatus continues to drive the demagnetizing coil (Step S515).

As described above, conventionally, the excitation coil is first heated and a printing process is started, and then, it is determined whether the demagnetizing coil is driven or not based on the detected temperature at the lateral ends of the fixing roller. As a result, because the entire width of the fixing roller is heated by the excitation coil regardless of the sheet size, if a smaller-sized sheet is to be printed, even the lateral ends which need not be heated are also heated. Accordingly, heat generation efficiency is not improved and a standby time of the apparatus is not reduced.

First Embodiment

Figure 6:
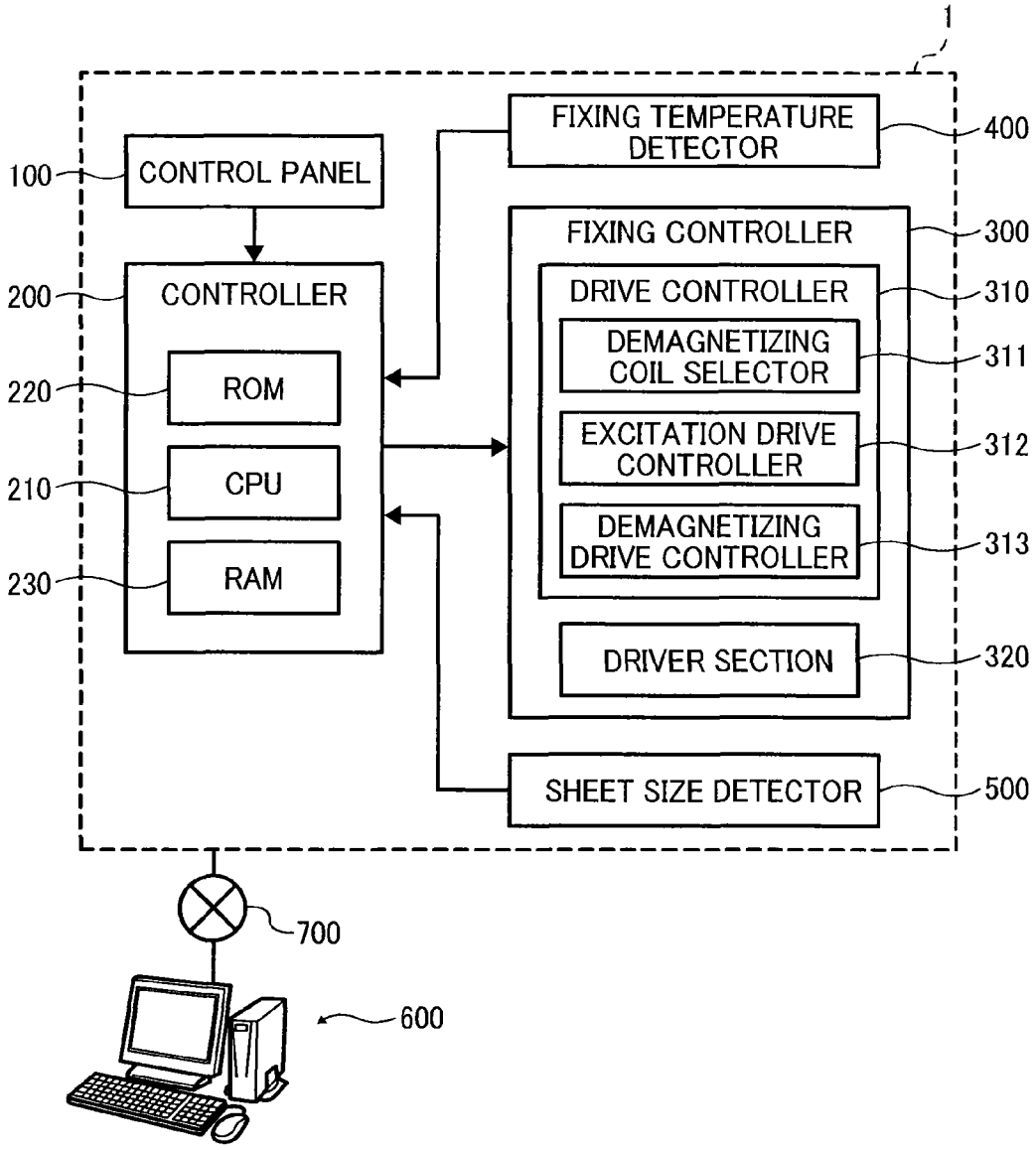
FIG. 6 is a schematic block diagram of an image forming apparatus according to the first embodiment of the present invention.
Figure 7:
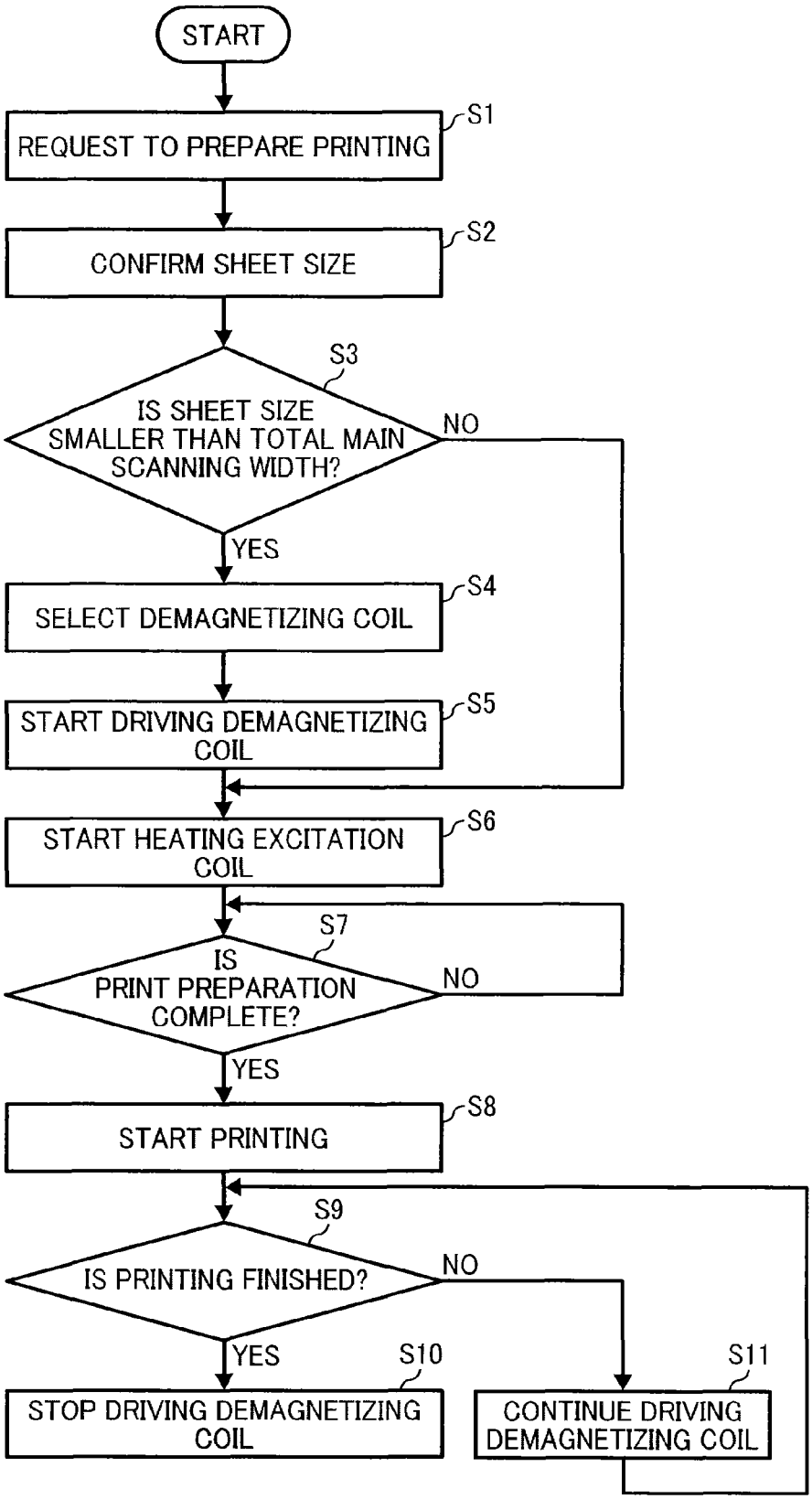
FIG. 7 is a control flow chart of the demagnetizing coil included in the fixing device according to the first embodiment of the present invention.

With reference to FIGS. 6 and 7, a control process of the demagnetizing coil 12 of the fixing device 10 in the image forming apparatus 1 will be described according to a first embodiment of the present invention.

First, the image forming apparatus receives a request-to-prepare-printing signal from a user inputting on the control panel 100, for example, and starts to prepare printing (Step S1). The image forming apparatus 1 obtains, for example, information related to the sheet P, such as sheet size, thickness, whether or not special paper, and the like, from the information on the image received from the computer 600 connected via the network 700 (Step S2).

Information on the received image further includes image data obtained via a scanner installed in the image forming apparatus 1. In addition, the information related to the sheet size may be obtained from the sheet size detector 500.

The image forming apparatus selects a suitable sheet P from the paper tray based on the obtained image data and feeds the sheet. Then, the demagnetizing coil selector 311 obtains the sheet size information from the controller 200 and determines whether the obtained sheet size is smaller than the entire width in the main scanning direction (Step S3). If the demagnetizing coil selector 311 determines that the obtained sheet size is smaller than the entire width in the main scanning direction (Yes in Step S3), the demagnetizing coil selector 311 selects the demagnetizing coil 12 suitable for the non-printing area when the obtained small-sized sheet is passed (Step S4).

Then, the demagnetizing drive controller 313 sends out a control signal to drive the selected demagnetizing coil 12, to the driver section 320. Effectively, the demagnetizing coil 12 selected by the driver section 320 is driven (Step S5). Specifically, as illustrated in FIG. 4, the relay circuit is closed so that the selected demagnetizing coil 12 is controlled to power on.

Next, the driver section 320 controlled by the excitation drive controller 312 turns on the excitation coil 11 (Step S6). As a result, an alternating magnetic field is formed and an eddy current is generated in the heat generation layer 13*c* to generate joule heat, so that the heat generation layer 13*c* is induction-heated.

The demagnetizing coil 12 can be driven either immediately before or after the excitation coil 11 is powered on. However, if the demagnetizing coil 12 is driven before the excitation coil 11 is powered on, heat generation efficiency is improved and standby time can be reduced remarkably.

In the present embodiment, when the relay circuit is closed, alternating current flows to the demagnetizing coil 12 due to the induced alternating voltage. In an area where the selected demagnetizing coil 12 is disposed, the magnetic flux of the excitation coil 11 acting on the fixing roller 13 decreases.

On the other hand, in an area where the activated demagnetizing coil 12 is not opposed, current flowing into the excitation coil 11 increases and the temperature of the fixing roller 13 rises quickly, as described in detail below.

Further, in the present embodiment, after the start of printing, for example, if the demagnetizing coil 12 is operated before starting induction heating upon receipt of the sheet size information of the sheet P, it is possible to prevent an excess temperature increase in the non-printing area when a small-sized sheet is to be printed.

Thus, without mounting an especially large-scale device, damage to the surface of the fixing roller 13 due to the excess temperature increase even when a small-sized sheet is continuously printed can be prevented, thereby improving durability and performance of the apparatus.

Upon termination of heating the excitation coil 11 and preparation for printing (Yes in Step S7), the image forming apparatus 1 starts print processing (Step S8). Then, when the image forming apparatus 1 receives a print end signal (Yes in Step S9), the driver section 320 controlled by the excitation drive controller 312 and the demagnetizing drive controller 313 causes the excitation coil 11 and the demagnetizing coil 12 to stop driving (Step S10).

On the other hand, if the print end signal is not received from the controller 200 (No in Step S9), the driver section 320 controlled by the excitation drive controller 312 and the demagnetizing drive controller 313 causes the excitation coil 11 and the demagnetizing coil 12 to continue driving (Step S11).

Next, results of a comparison between the control of the fixing device according to the embodiment of the present invention and a conventional example will be described with reference to FIGS. 8 to 10.

Figure 8:
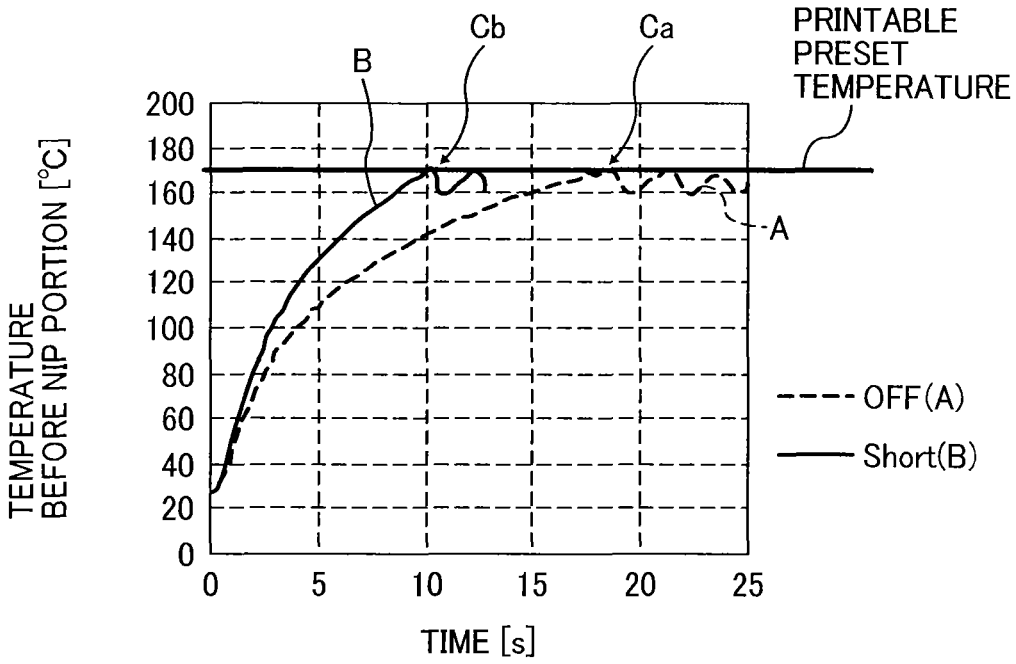
FIG. 8 is a graph comparing a rise time of the fixing device by the control method of the present invention and a conventional control method.

FIG. 8 is a graph showing a rise time by the control method of the present invention and that by a conventional method. The preset temperature necessary for activating the fixing device is set to 170 degrees C. in the present invention.

Specifically, the present invention and the conventional art are compared by the difference of the rise time of the fixing device when printing a postcard-size sheet with the fixing device of the image forming apparatus capable of printing up to A3 sheet. A horizontal axis represents time in seconds and a vertical axis represents temperature at the nip portion in degrees C. By switching on and off the relay circuit of the demagnetizing coil, the rise time taken to reach the preset fixing temperature is compared. A solid curved line B shows when the relay circuit is switched on or short-circuited and a broken curved line A shows when the relay circuit is switched off.

Further, a surface temperature of the fixing roller is measured when power of 1200 Watts is supplied in the same condition of the fixing device. In this case, the fixing roller is heated by electromagnetic induction heating of the excitation coil; however, when the temperature of the fixing roller reaches 170 degrees C., the thermostat starts to control the temperature and turns on the power to the excitation coil. As a result, the temperature temporarily decreases.

Results of the comparison show that the rise time when the power is supplied to the fixing device in the conventional art is 18 seconds (see Ca). On the other hand, when the power is supplied to the fixing device in the present invention, the rise time is approximately 10 seconds (see Cb). Accordingly, it is apparent that the fixing device attains the preset fixing temperature in a short time than in the conventional art.

Figure 9:
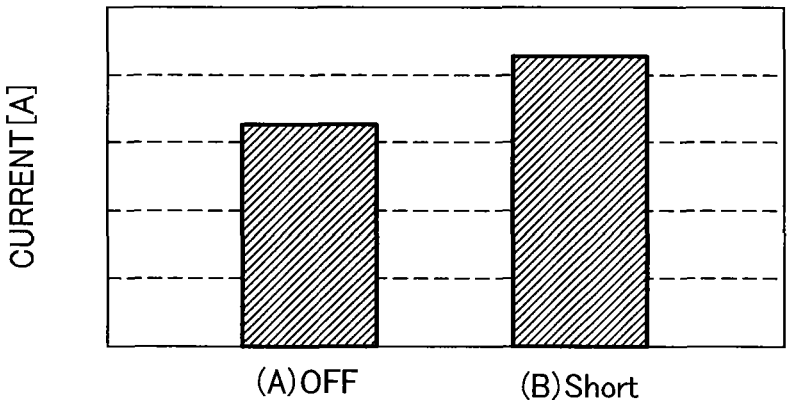
FIG. 9 is a graph comparing a current amount when measuring the rise time of the fixing device by the control method of the present invention and a conventional control method.

FIG. 9 is a bar graph comparing a current amount [A] when measuring the rise time of the fixing device by the control method of the present invention and the conventional control method. A vertical rectangle (A) shows a current amount in the conventional art in which the demagnetizing coil is not driven immediately after the start of preparing printing and a vertical rectangle (B) shows a current amount of the present invention in which the demagnetizing coil is driven after the start of preparing printing.

Figure 10:
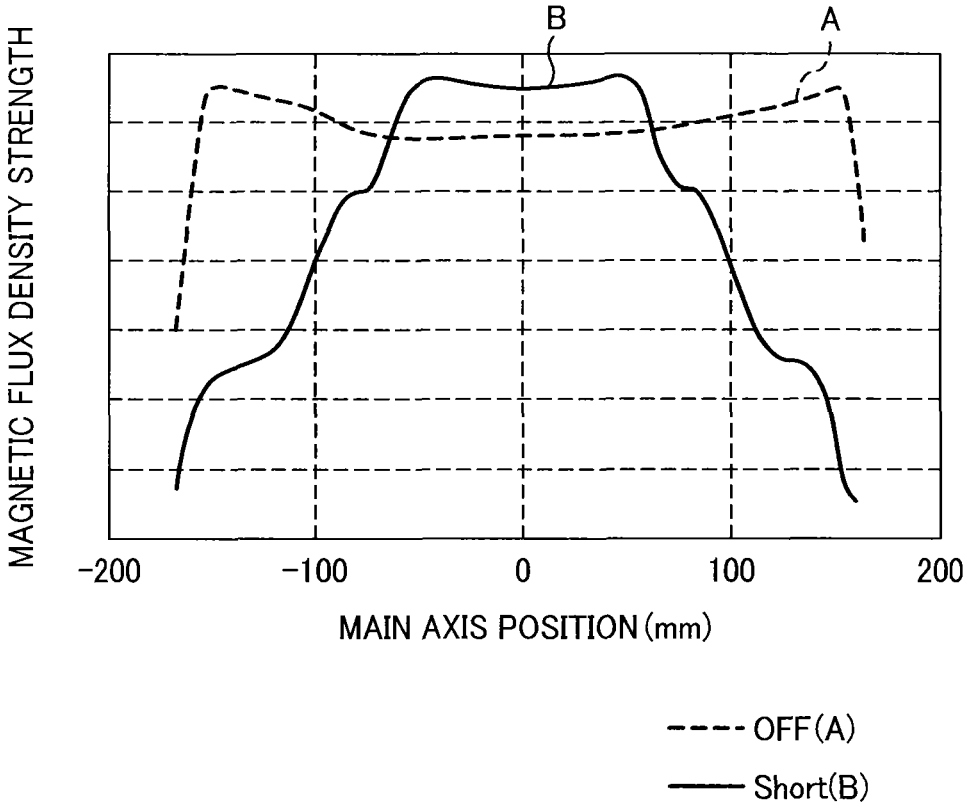
FIG. 10 is a graph comparing a magnetic field strength when measuring the rise time of the fixing device by the control method of the present invention and a conventional control method.

Further, FIG. 10 is a graph comparing magnetic flux density strength when measuring the rise time of the fixing device by the control method of the present invention and the conventional control method. A broken curved line A shows the magnetic flux density strength according to the conventional control method and a solid curved line B shows the magnetic flux density strength according to the present invention.

In both FIG. 9 and FIG. 10, when the demagnetizing coil is activated as in the present invention, both the current amount and the magnetic flux density strength are higher than in the case of conventional control method.

As a result, it is apparent that the heat generation efficiency of the portion opposed to the demagnetizing coil increases when the demagnetizing coil is activated. This effect will be described below.

As is known, electrical power (P) is introduced using current (I) and resistance (R) by the following formula 1:

$$P=I^2R \qquad \text{Formula 1}$$

In the present embodiment, the fixing device is controlled by a constant electrical power $P_1$. In this case, the current value is set to $I_1$ and the resistance value $R_1$. Inventors verify that the following formula 2 stands when the demagnetizing coil is driven.

$$P_1=I_1^2R_1=I_1^2(Rmc+Rr+Rms-x) \qquad \text{Formula 2}$$

In the conventional art, the fixing device is controlled by a constant power $P_2$. In this case, the current value is set to $I_2$ and the resistance value $R_2$. The inventors verify that the following formula 3 stands when the demagnetizing coil is not driven.

$$P_2=I_2^2R_2=I_2^2(Rmc+Rr) \qquad \text{Formula 3}$$

In the formulae 2 and 3, Rmc represents resistance of the excitation coil, Rr the resistance of the fixing roller, Rms the resistance of the demagnetizing coil, and x the resistance corresponding to the power which does not flow to the fixing roller due to turning on the demagnetizing coil.

From the above formulae 1 to 3, it is apparent that $R_2$ is greater than $R_1$ when x is greater than Rms. In this case, when the power $P_1$ is equal to $P_2$, $I_1$ is greater than $I_2$. As a result, it is apparent that more current flows in the excitation coil when the demagnetizing coil is driven, and the temperature of a portion of the fixing roller not opposed to the demagnetizing coil increases.

Second Embodiment

Figure 11:
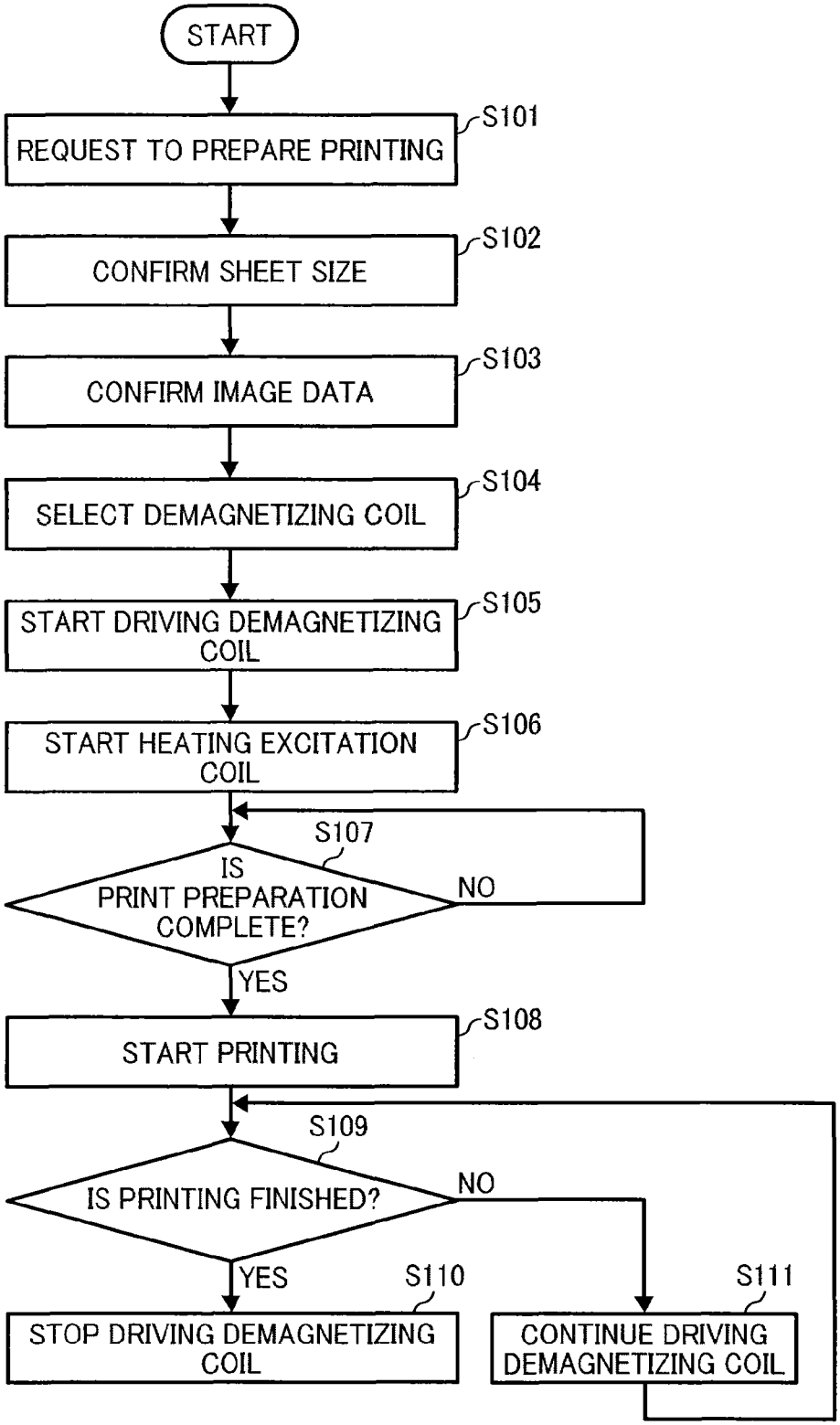
FIG. 11 is a modified control flow chart of the demagnetizing coil included in the fixing device according to the first embodiment of the present invention.

Next, control of the demagnetizing coil 12 of the fixing device 10 in the image forming apparatus 1 according to a second embodiment will be described referring to FIG. 11. A redundant description concerning the same control process as in the first embodiment will be omitted. Specifically, image size information is used in addition to the sheet size information in controlling driving of the demagnetizing coil in the second embodiment.

In the second embodiment, the controller 200 obtains the sheet size information (Step S102), and then the image data size information (Step S103) from image data received from the computer 600, for example. Normally, it is rare that the output image covers a whole sheet. Rather, the image in one page may include large blank portions. For example, when a document data is to be printed, top and bottom, and both lateral portions are left blank.

In the second embodiment, the demagnetizing coil is driven considering end blank spaces such as page margins. Specifically, in the second embodiment, heating of the end blank spaces of the fixing roller is reduced in addition to the non-printing area based on the information on the end non-print areas, thereby further reducing the rise time.

Third Embodiment

Figure 12:
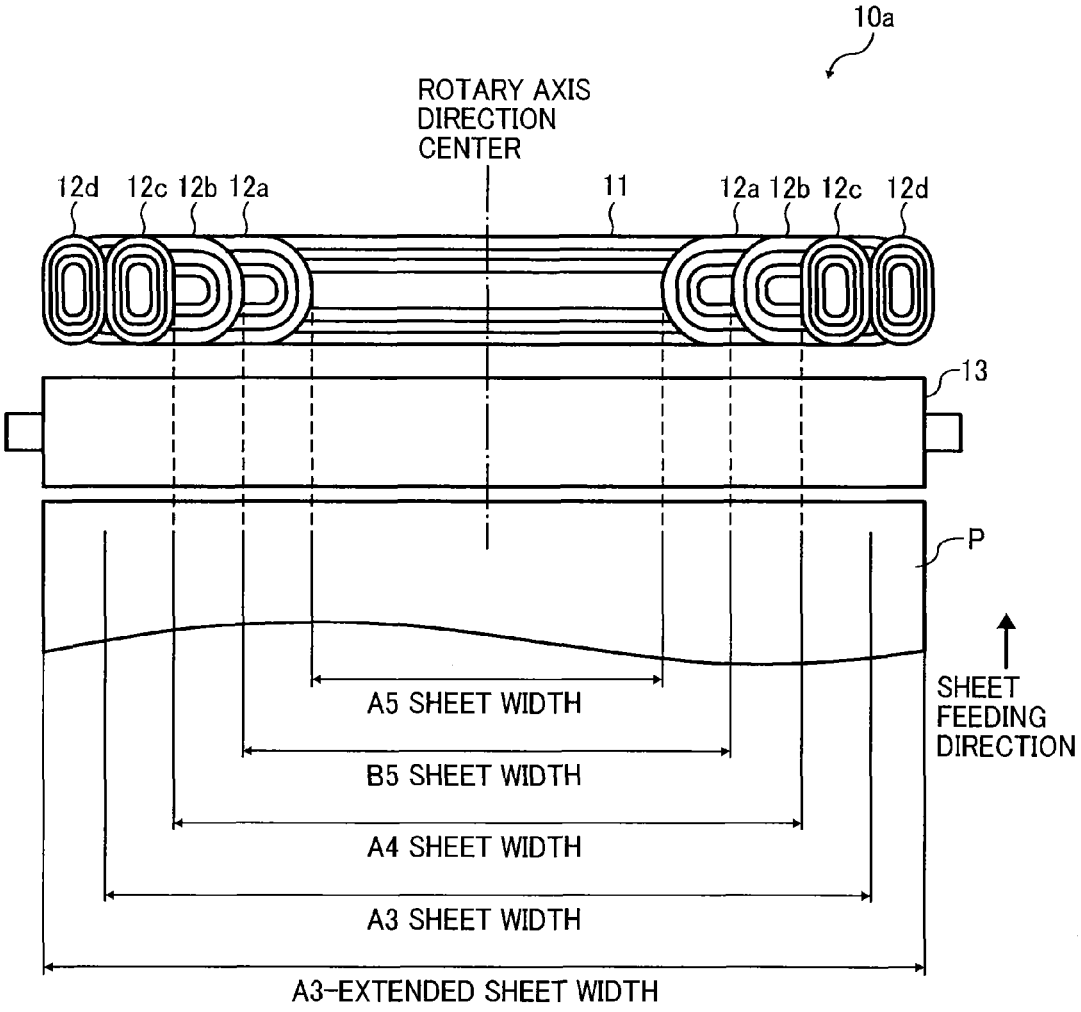
FIG. 12 is a schematic view of a fixing device according to a second embodiment of the present invention.

Next, a fixing device 10*a* according to a third embodiment of the present invention will be described with reference to FIG. 12. The fixing device 10*a* is different from the fixing device 10 according to the first embodiment in that a demagnetizing coil 12*d* is added and lengths of the heating roller and the excitation coil in the rotary axis direction are different. Accordingly, a redundant description concerning the same structure as in the first embodiment will be omitted.

Specifically, in the image forming apparatus handling an irregular sheet, when the fixing roller and the excitation coil are long in the rotary axis direction to handle the irregularly longer sheet, the present embodiment is applied to a case in which the demagnetizing coil is mounted to cover an excess area longer in the rotary axis direction than the regular sheet width.

First, the image forming apparatus handling an irregular sheet will be described. Recently, demand for printed materials such as pamphlets in only a small number of copies using image forming apparatuses such as copiers and printers has increased.

In the printed matter, ruled lines called trim marks are created outside the finished dimensions. The trim marks serve as a mark to adjust colors in color printing or to cut the sheet in a standard size for the printer. As a result, it is customary in the printing industry that designs for A4-size sheet are printed on the B4 sheet, and B4-designs are printed on the A3 sheet, that is, the recording material larger than the target image size is used.

However, designs for the A3-size sheet cannot be printed with trim marks. In addition, the A4-size pamphlets are in many cases folded in two after having been printed in A3-size. So, a recent trend in demands for printing transfers to A3-size designs. As a result, users request the image forming apparatus to handle an irregular SRA3-size sheet that may include a space for trim marks in addition to A3-size sheet. The SRA3 is a size 320 mm in width×450 mm in length. Because the SRA3 sheet is mainly used for printing a small number of copies of pamphlets and the like, use frequency is low in general-purpose printing. However, because the fixing roller and the excitation coil are lengthened corresponding to the width of the A3-extended sheet, a longer rise time is taken even in printing the regular sheet.

In the third embodiment, if the sheet width for printing is not A3-extended size, the demagnetizing coils 12*d* mounted at both lateral ends and corresponding to the A3-extended size are activated and induction heating is started. As a result, even in the image forming apparatus for the A3-extended size, the rise time can be shortened.

Fourth Embodiment

Figure 13:
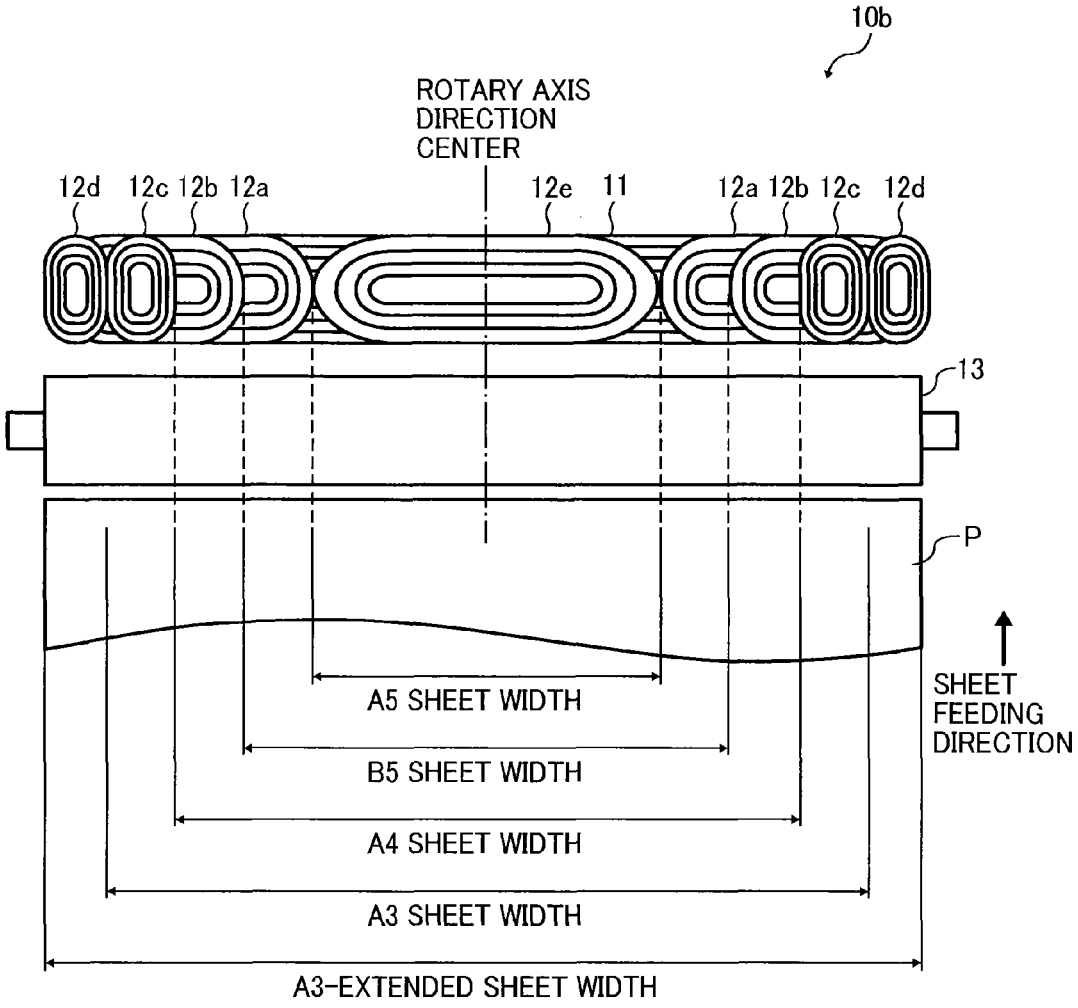
FIG. 13 is a schematic view of a fixing device according to a third embodiment of the present invention.

Next, a fixing device 10*b* according to a fourth embodiment of the present invention will be described with reference to FIG. 13. The fixing device 10*b* is different from the fixing device 10*a* according to the third embodiment in that a demagnetizing coil 12*e* is added as illustrated in FIG. 13. A redundant description concerning the same structure as in the first and third embodiments will be omitted.

As illustrated in FIG. 13, in the fourth embodiment, the demagnetizing coil 12*e* as a second demagnetizing coil is mounted in the center of the fixing device 10*b* in the image forming apparatus handling the irregular sheet. As a result, when a sheet with a maximum width is to be printed after a small-sized sheet has been printed, if the demagnetizing coil 12*e* is activated, heat generation of the heating area of the excitation coil opposed to the demagnetizing coil 12*e* is prevented and more current flows to the excitation coil 11 disposed at both lateral ends. Accordingly, the fixing roller at both lateral ends can be speedily heated.

Figure 14:
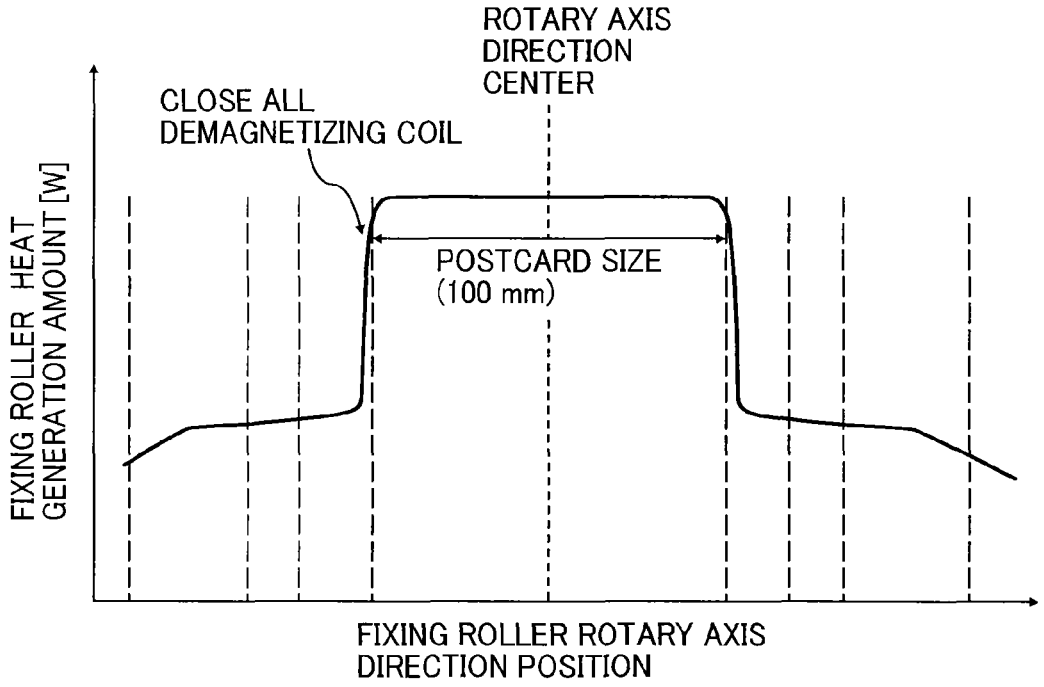
FIG. 14 is a graph showing temperature distribution of the fixing device in the rotary axis direction according to the third embodiment of the present invention.

FIG. 14 is a graph showing temperature distribution of the fixing device in the rotary axis direction when a postcard-size sheet with 100 mm width is continuously printed according to a fourth embodiment of the present invention. When the postcard-size sheets are continuously printed, the relay for the demagnetizing coil corresponding to a non-printing area is closed.

Heating by the excitation coil of the area outside the printing area for the small-sized sheet is prevented because the demagnetizing coil is activated. Because the temperature in a range extending from outside the lateral ends of the postcard to the lateral ends of the fixing roller is kept low, if the sheets with larger widths such as B5-, A4-, A3-sizes are continuously printed, an abnormal image may be created due to cold offset.

As a result, both lateral ends need be heated, but it takes time for the temperature for the fixing roller to reach an evenly printable temperature. In addition, because the center portion having a high temperature is excessively heated, the load on the fixing roller increases.

In such a case, in the fourth embodiment, activation of the demagnetizing coils 12*a* to 12*d* at lateral ends is released, and instead, the demagnetizing coil 12*e* disposed in the center portion in the axial direction of the fixing roller is activated. Thus, the area outside the postcard-size sheet passing area and the A3-size and A3-extended-size sheet passing area can be heated intensively.

When the demagnetizing coil 12*e* is closed, heating in the central portion opposed to the demagnetizing coil 12*e* remains limited. However, because the heat generated at both lateral ends is propagated, a drastic temperature decrease does not occur and the temperature distribution of the fixing roller in the rotary axis direction can be made uniform quickly. Specifically, because current in the portion opposed to the driving demagnetizing coil is transmitted to the portion not opposed to the demagnetizing coil, temperature of the portion where the demagnetizing coil is not activated rises quickly.

As described above, when the small-sized sheet is passed, because the demagnetizing coils 12*a* to 12*d* at lateral ends are driven, the temperature distribution is as illustrated in FIG. 14. When the large size sheet passes immediately after the small size sheet, the temperature at the lateral ends need be increased promptly. However, although the central portion of the fixing roller is heat absorbed due to the sheet passing, the temperature in the central portion thereof is higher than that in the lateral ends. Then, by driving the demagnetizing coil in the central portion, the temperature in the central portion is prevented from increasing more than the preset temperature and the temperature rising speed at the lateral ends can be increased.

Figure 15A:
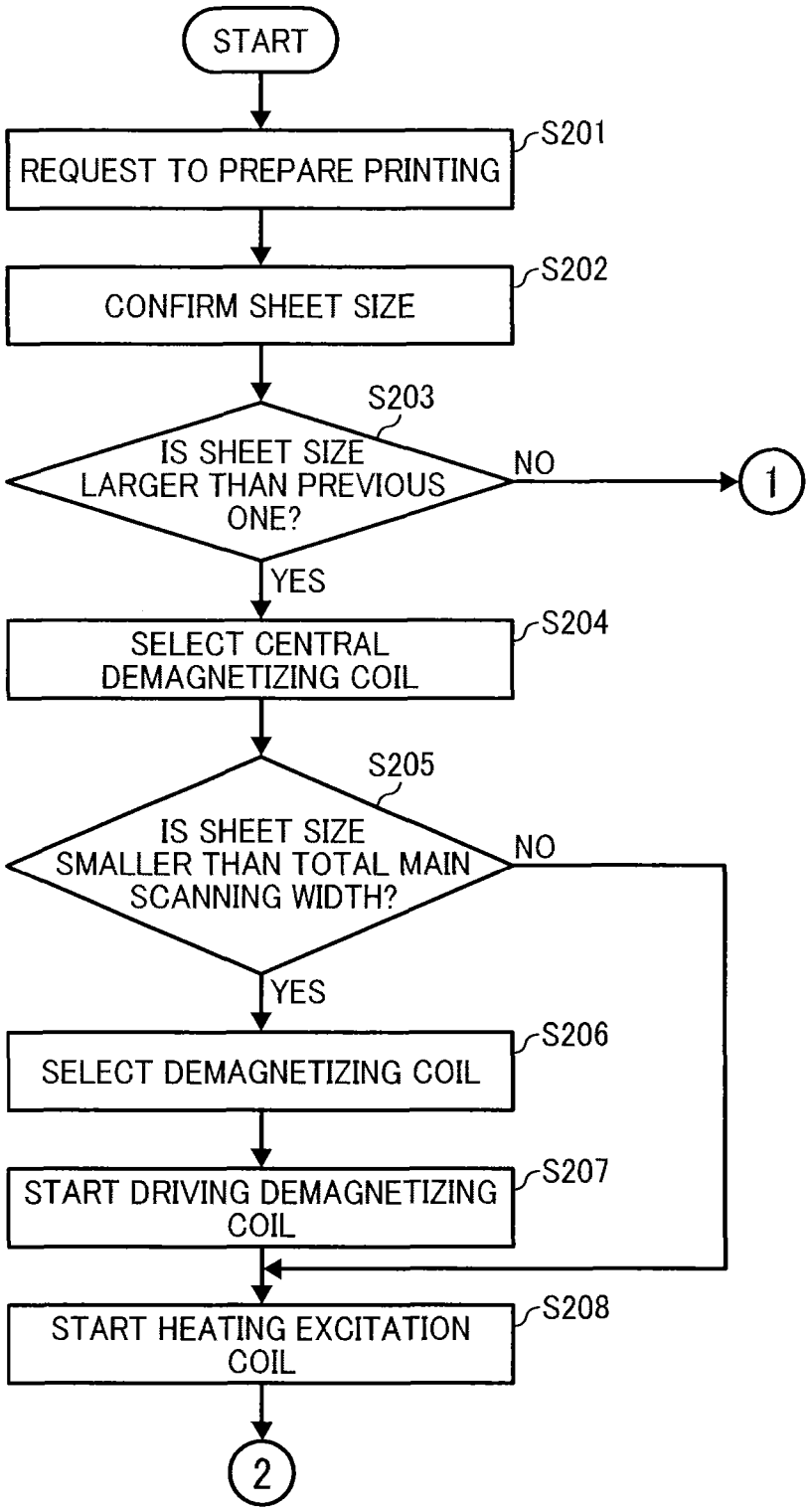
FIGS. 15A to 15C are control flow charts of the demagnetizing coil included in the fixing device according to the third embodiment of the present invention.
Figure 15B:
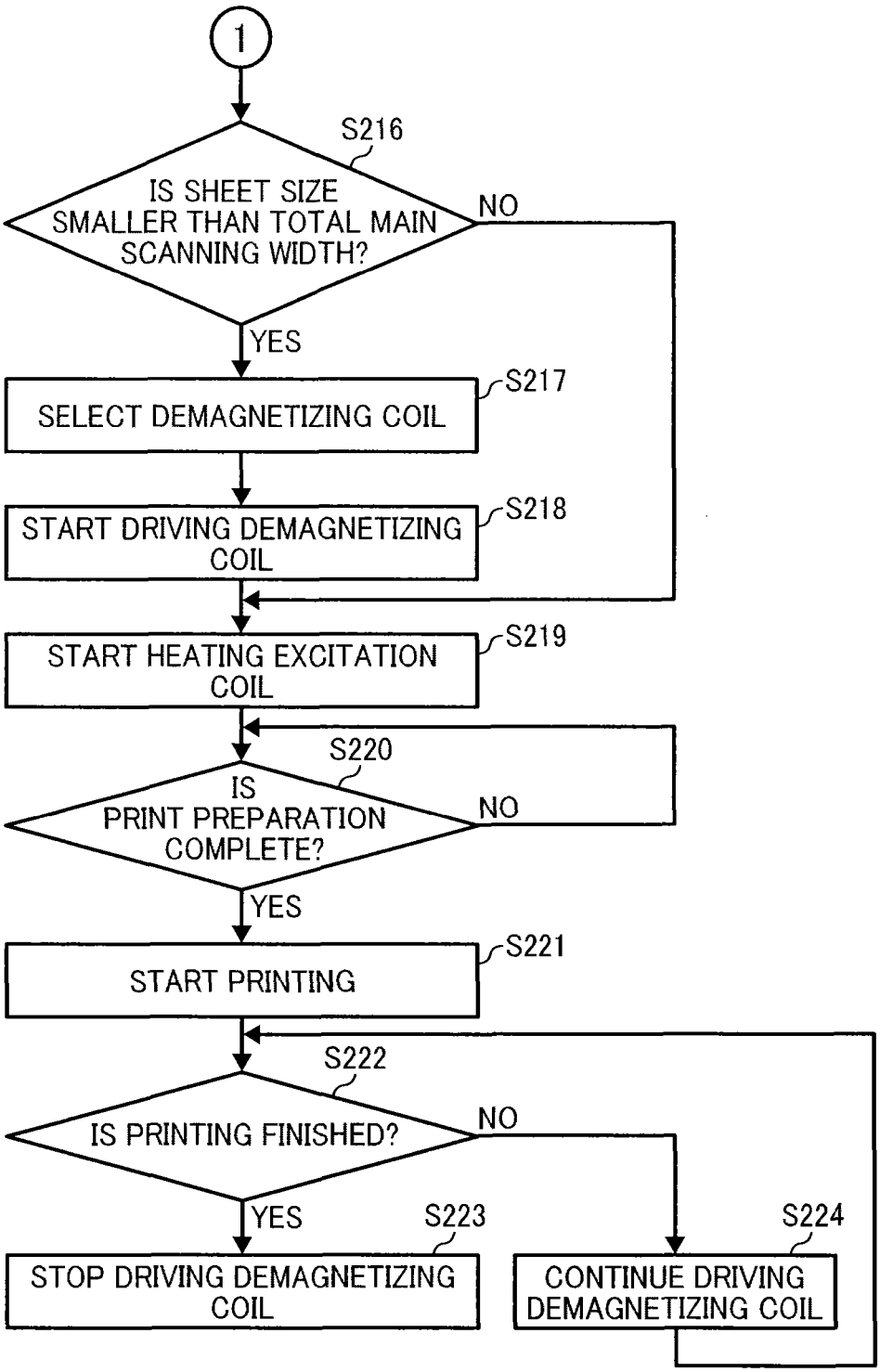
Figure 15C:
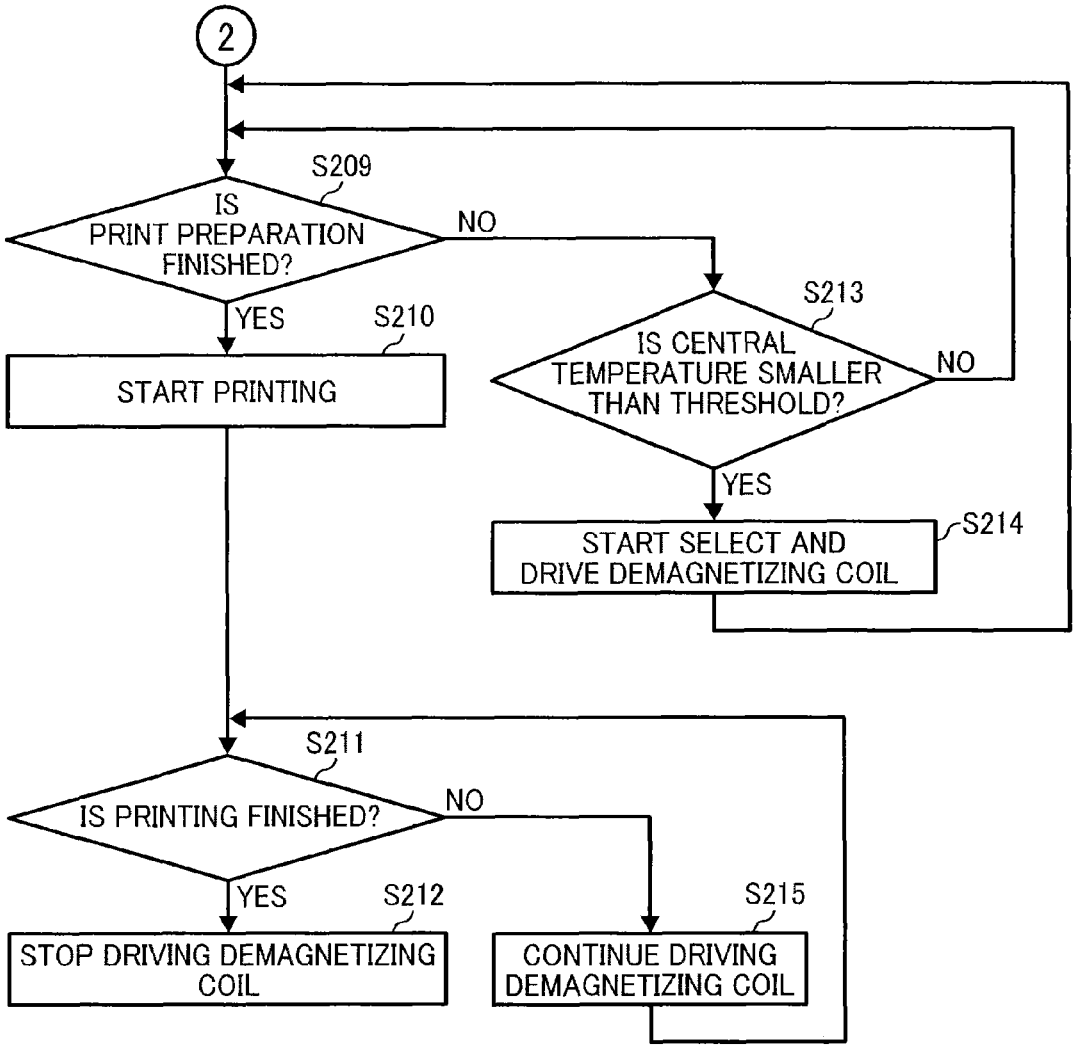

FIGS. 15A to 15C show steps in control process of the fixing device 10*b* in the fourth embodiment. The redundant description concerning the same structure as in the first to third embodiments will be omitted. Herein, for convenience, a single image forming process is used as a "job".

The demagnetizing coil selector 200 obtains the sheet size information from the controller 200 and determines whether the obtained sheet size is larger than the sheet size in the previous job (Step S203). Then, if the demagnetizing coil selector 311 determines that the sheet size in the current job is larger than the sheet size in the previous job (Yes in step S203), the demagnetizing coil selector 311 selects the demagnetizing coil 12*e* (Step S204).

Next, if the sheet size in the current image forming job is smaller than the main scanning width (Yes in Step S205), the demagnetizing coil selector 311 selects a demagnetizing coil that need not be heated disposed at the sheet-non-passing area (Step S206). Then, the demagnetizing drive controller 313 sends a control signal to drive the selected demagnetizing coil together with the demagnetizing coil 12*e* to the driver section 320. Then, the selected demagnetizing coil and the demagnetizing coil 12*e* are driven by the driver section 320 (Step S207).

In the present embodiment, the demagnetizing coils corresponding to the central area with a temperature higher than the lateral ends and a non-sheet passing area are switched on, and thus, the heat given to the central portion or the area not needed to be heated is circulated to the necessary portion, thereby improving the heat efficiency of the low-temperature portions and enabling quick and even preparation for printing.

If the temperature becomes the preset temperature uniformly over the fixing roller, the print preparation terminates (Yes in Step S209) and the printing is started (Step S210). If the printing preparation is not finished (No in Step S209), the controller 200 checks if the detected temperature in the central area is decreased too much compared to the preset threshold (Step S213).

If the controller 200 determines that the detected temperature in the central portion is less than the threshold (Yes in Step S213), the demagnetizing drive controller 313 sends a control signal to stop the demagnetizing coil 12*e* to the driver section 320, so that the excitation drive controller 312 sends a control signal to drive the excitation coil 11 to the driver section 320. Then, the driver section 320 stops driving the demagnetizing coil 12*e*, and the central area is heated by the driving of the excitation coil 11 (Step S214). On the other hand, when the detected temperature is not decreased to be less than the threshold (No in Step S213), the demagnetizing coil 12*e* remains to be driven.

On the other hand, if the demagnetizing coil selector 311 determines that, from the obtained sheet size information, the sheet size in the current job is equal to or smaller than the sheet size in the previous job (No in Step S203), the demagnetizing coil selector 311 determines whether the current sheet size is smaller than the main scanning width (Step S216).

Then, if it is determined that the sheet size in the current job is smaller than the main scanning width (Yes in Step S216), the demagnetizing coil selector 311 selects a demagnetizing coil in an area where the sheet does not pass and sends a drive signal to drive the selected demagnetizing coil to the driver section 320.

On the other hand, if it is determined that the sheet size in the current job is equal to or larger than the main scanning width (No in Step S216), the demagnetizing coil selector 311 does not select any demagnetizing coil and the excitation drive controller 312 sends a signal to drive the excitation coil 11 to the driver section 320.

Thus, in each of the embodiments according to the present invention, the demagnetizing coils are disposed at different areas of the fixing roller and the demagnetizing coil disposed at an area where heating is not necessary is activated, so that the temperature of the fixing roller in an area where heating is necessary can be increased to a preset temperature in a short time. With this effect, even when a large size sheet should be printed immediately after the small size sheet has been printed, an optimal fixation is possible with a short rise time.

The present invention is not limited to the embodiments described heretofore, and can be applied to other embodiments modified in a range without distorting from the concept of the present invention.

For example, control operations executed in each part constituting the image forming apparatus or the fixing device according to the present embodiment can be implemented using hardware, software, or a combination of hardware and software.

When the processing is executed by software, a program storing the process sequence is installed in a memory of a computer, in which the memory is installed in dedicated hardware, so that the process sequences can thus be executed. Otherwise, a program is installed in a general-purpose computer capable of executing various processing and the program can be executed.

For example, the program can be pre-recorded onto recording media such as a hard disk or a Read-Only-Memory (ROM). Alternatively, the program can be temporarily or permanently stored in a removable recording medium. Such removable recording media can be offered as packaged software. Removable recording media include a Floppy™ disk, a CD-ROM (compact disc read-only memory), an MO (magneto optical disk), a DVD (digital versatile disc), a magnetic disk, a semiconductor memory, and the like.

The program can be installed from the above-described removable recording media to the computer. Alternatively, the program can be wirelessly transferred to the computer from a download site, or wire-transferred to the computer via the network.

The image forming apparatus or the fixing device described above may be configured to execute the program in chronological order according to the processing operation as illustrated herein or to execute the program in parallel or individually if necessary as well.

Additional modifications and variations of the present invention are possible in light of the above teachings. It is therefore to be understood that, within the scope of the appended claims, the invention may be practiced other than as specifically described herein.

What is claimed is:

1. A fixing device comprising:

a rotary member including a heat generation layer;

an excitation coil generating magnetic flux, disposed along an axial direction of the rotary member, to heat by induction the heat generation layer of the rotary member;

a first demagnetizing coil layered on the excitation coil and generating magnetic flux in a direction reverse to and cancelling out the magnetic flux that the excitation coil generates;

a sheet size detector to obtain a size of a recording sheet on which an image is to be formed by passing through the rotary member;

a drive controller to control driving of the first demagnetizing coil; and a second demagnetizing coil layered on the excitation coil and generating magnetic flux in a direction reverse to and cancelling out the magnetic flux that the excitation coil generates, wherein the drive controller drives the first demagnetizing coil after information including the sheet size has been obtained, and wherein the second demagnetizing coil is disposed opposite the center portion in the axial direction of the rotary member, and the drive controller obtains the information of the recording sheet to be passed through the rotary member including the sheet size information and controls to drive the second demagnetizing coil.

2. A fixing device comprising:

a rotary member including a heat generation layer;

an excitation coil generating magnetic flux, disposed along an axial direction of the rotary member, to heat by induction the heat generation layer of the rotary member;

a first demagnetizing coil layered on the excitation coil and generating magnetic flux in a direction reverse to and cancelling out the magnetic flux that the excitation coil generates;

a sheet size detector to obtain a size of a recording sheet on which an image is to be formed by passing through the rotary member;

a drive controller to control driving of the first demagnetizing coil; and a second demagnetizing coil layered on the excitation coil and generating magnetic flux in a direction reverse to and cancelling out the magnetic flux that the excitation coil generates, wherein the drive controller drives the first demagnetizing coil after information including the sheet size has been obtained, wherein the second demagnetizing coil is disposed opposite the center portion in the axial direction of the rotary member, and the drive controller obtains the information of the recording sheet to be passed through the rotary member including the sheet size information and controls to drive the second demagnetizing coil; and wherein the drive controller selects the second demagnetizing coil when it is determined that the sheet size obtained in a current image forming process is larger than the sheet size obtained in a previous image forming process.

3. The fixing device as claimed in claim 1, wherein:

the drive controller further comprises a demagnetizing coil selector;

multiple first demagnetizing coils are disposed at opposite lateral ends in an axial direction of the rotary member; and the demagnetizing coil selector selects the first demagnetizing coil disposed opposite a non-sheet-passing area through which the recording sheet does not pass based on a size of the recording sheet obtained by the sheet size detector.

4. The fixing device as claimed in claim 3, wherein the demagnetizing coil selector obtains the non-sheet-passing area from a difference between a length of the rotary member in the rotary axis direction and a widthwise length of the recording sheet obtained by the sheet size detector.

5. The fixing device as claimed in claim 3, wherein each of the multiple first demagnetizing coils has external dimensions in the axial direction of the rotary member that differ from any other first demagnetizing coil.

6. The fixing device as claimed in claim 3, wherein the demagnetizing coil selector obtains image data related to an image formed on the recording sheet and selects the first demagnetizing coil disposed opposite an unused area of the recording sheet where no image is formed based on the image data.

7. An image forming apparatus comprising a fixing device as claimed in claim 1.

8. The fixing device as claimed in claim 2, wherein:

the drive controller further comprises a demagnetizing coil selector;

multiple first demagnetizing coils are disposed at opposite lateral ends in an axial direction of the rotary member; and the demagnetizing coil selector selects the first demagnetizing coil disposed opposite a non-sheet-passing area through which the recording sheet does not pass based on a size of the recording sheet obtained by the sheet size detector.

9. The fixing device as claimed in claim 8, wherein the demagnetizing coil selector obtains the non-sheet-passing area from a difference between a length of the rotary member in the rotary axis direction and a widthwise length of the recording sheet obtained by the sheet size detector.

10. The fixing device as claimed in claim 8, wherein each of the multiple first demagnetizing coils has external dimensions in the axial direction of the rotary member that differ from any other first demagnetizing coil.

11. The fixing device as claimed in claim 8, wherein the demagnetizing coil selector obtains image data related to an image formed on the recording sheet and selects the first demagnetizing coil disposed opposite an unused area of the recording sheet where no image is formed based on the image data.

12. An image forming apparatus comprising a fixing device as claimed in claim 2.

* * * * *